US010851788B2

(12) United States Patent
Lucas et al.

(10) Patent No.: US 10,851,788 B2
(45) Date of Patent: Dec. 1, 2020

(54) VACUUM PUMP WITH NOISE ATTENUATING PASSAGE

(71) Applicant: Ingersoll-Rand Industrial U.S., Inc., Davidson, NC (US)

(72) Inventors: Michael J. Lucas, Mooresville, NC (US); Thomas Gholami-Zouj, Wasquehal (FR); Christian Doucet, Pointe Claire (CA); Jan Bart Taminiau, Wasquehal (FR); Gautier Lombart, Hangest en Santerre (FR)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 186 days.

(21) Appl. No.: 16/227,826

(22) Filed: Dec. 20, 2018

(65) Prior Publication Data

US 2020/0200178 A1 Jun. 25, 2020

(51) Int. Cl.

| | |
|---|---|
| ***F04C 29/06*** | (2006.01) |
| ***F04C 29/04*** | (2006.01) |
| ***F04C 18/12*** | (2006.01) |

(52) U.S. Cl.

CPC ..... *F04C 29/06* (2013.01); *F04C 18/126* (2013.01); *F04C 29/042* (2013.01); *F04C 29/065* (2013.01); *F04C 2270/13* (2013.01)

(58) Field of Classification Search

CPC .. F04C 18/126; F04C 2270/13; F04C 29/042; F04C 29/06; F04C 29/065

See application file for complete search history.

(56) References Cited

U.S. PATENT DOCUMENTS 9,140,260 B2 9/2015 Huang et al.
9,879,672 B2 * 1/2018 Moetakef ..... F04C 2/088

* cited by examiner

*Primary Examiner* — Mary Davis
(74) *Attorney, Agent, or Firm* — Taft Stettinius & Hollister LLP

(57) ABSTRACT

A vacuum roots blower includes a rotor capable of being rotated to capture a gas from an inlet and further rotated to discharge the captured gas from an outlet. The captured gas is held within a pocket formed between lobes of the rotor and the adjacent housing within which the rotor is rotated. The vacuum roots blower includes a pressure relief system capable of delivering a pressure relief gas to the pocket. The pressure relief system includes a sonic passage structured to produce a choked flow condition as the pressure relief system fills the pocket with pressure relief gas. In one form the pressure relief gas can be a cooling gas, but other forms such as ambient air are also contemplated.

20 Claims, 32 Drawing Sheets

0 degrees 30 degrees 80 degrees 90 degrees 110 degrees 0 degrees

VACUUM PUMP WITH NOISE ATTENUATING PASSAGE

TECHNICAL FIELD

The present invention generally relates to vacuum roots blowers, and more particularly, but not exclusively, to noise attenuation in vacuum roots blowers.

BACKGROUND

Noise generated during operation of a vacuum roots blower remains an area of interest. Some existing systems have various shortcomings relative to certain applications. Accordingly, there remains a need for further contributions in this area of technology.

SUMMARY

One embodiment of the present invention is a unique pressure relief system for a vacuum roots blower. Other embodiments include apparatuses, systems, devices, hardware, methods, and combinations for attenuating noise in vacuum roots blowers. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
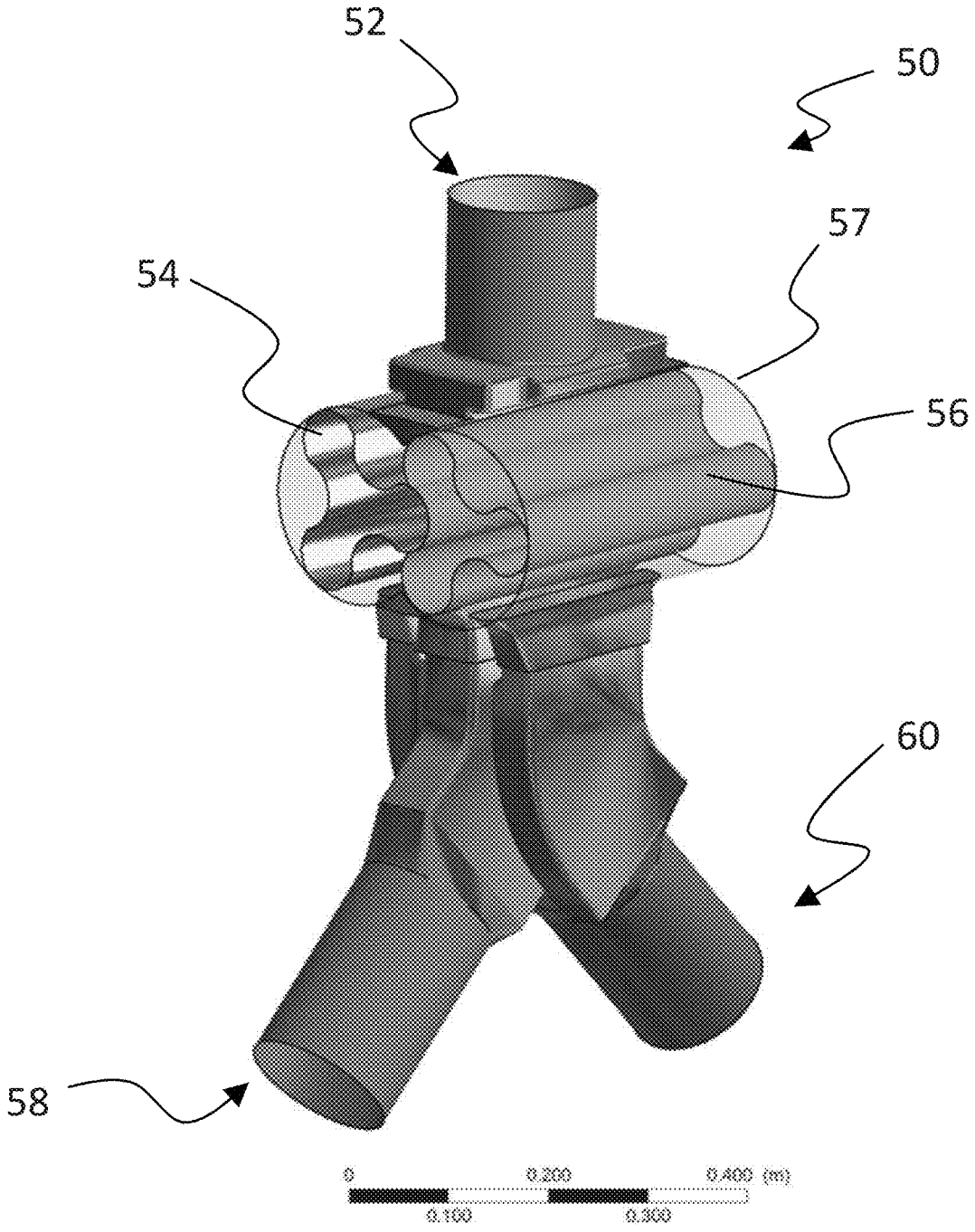
FIG. 1 PRIOR ART
FIG. 1 depicts a prior art embodiment of a vacuum roots blower.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, a prior art vacuum roots blower 50 is illustrated having an inlet 52 structured to provide a fluid to a pair of intermeshed rotors 54 and 56, the joint rotation of which in turn deliver the fluid to the outlet 58 for discharge from the blower 50. The pair of intermeshed rotors 54 and 56 are located within a housing 57. In some forms the rotors 54 and 56 include a two-dimensional cross sectional profile which is then extruded along a third dimension (aligned with the axis of rotation). The vacuum blower 50 is structured to pull fluid from the inlet 52 and drive it toward the outlet 58. Some embodiments of prior art vacuum blowers also include a cold air inlet, such as the cold air inlet 60 depicted in FIG. 1. The cold air inlet is useful to reduce the temperature of air exiting the outlet 58, but not all prior art blowers 50 include a cold air inlet. It will be appreciated that any other suitable cooling gas can be used rather than air. For convenience of description, however, reference will be made to "cooling air" or "cold air" without intention to limit such fluid to be of atmospheric air composition. Roots blowers such as those described herein find many applications in industry because in some forms they are structured as oil-free devices. Some of the applications for roots blowers are in the food processing industries, wastewater treatment plants, pumping dry goods into tanker trucks, and vacuum pumps used in street cleaners.

During a rotation sequence the rotors 54 and 56 are structured to capture a pocket of fluid from the inlet 52 and rotate the pocket to a position to either accept air from the cooling air inlet 60 or expose the pocket to the outlet 58 to complete the vacuum process from inlet 52 to outlet 58. The pocket is trapped between lobes of each respective rotor and a surface of the housing which encloses the rotors, further depictions of which can be found in the figures below. When the trapped pocket is rotated into position and exposed to either the cooling air inlet 60 or the outlet 58 an instantaneous or sudden in rush of fluid can be experienced which causes a rapid change in pressure. Such instantaneous or sudden in rush of fluid can be the result of a relatively large pressure differential existing between any fluid in the trapped pocket and that of a pressure at the cooling air inlet 60 and/or the outlet 58. Depending on operating conditions, the higher pressure air from the cooling air inlet 60 or the outlet 58 which rushes into the trapped pocket can form either or both shock and expansion waves which can reverberate and otherwise cause noise. The formation of shock waves can occur along the length of the rotor. Though the illustrated embodiment depicts respective rotors 54 and 56 each having three lobes, other embodiments can have a different number of lobes. For example, some embodiments can include four or five lobed rotors.

Figure 2:
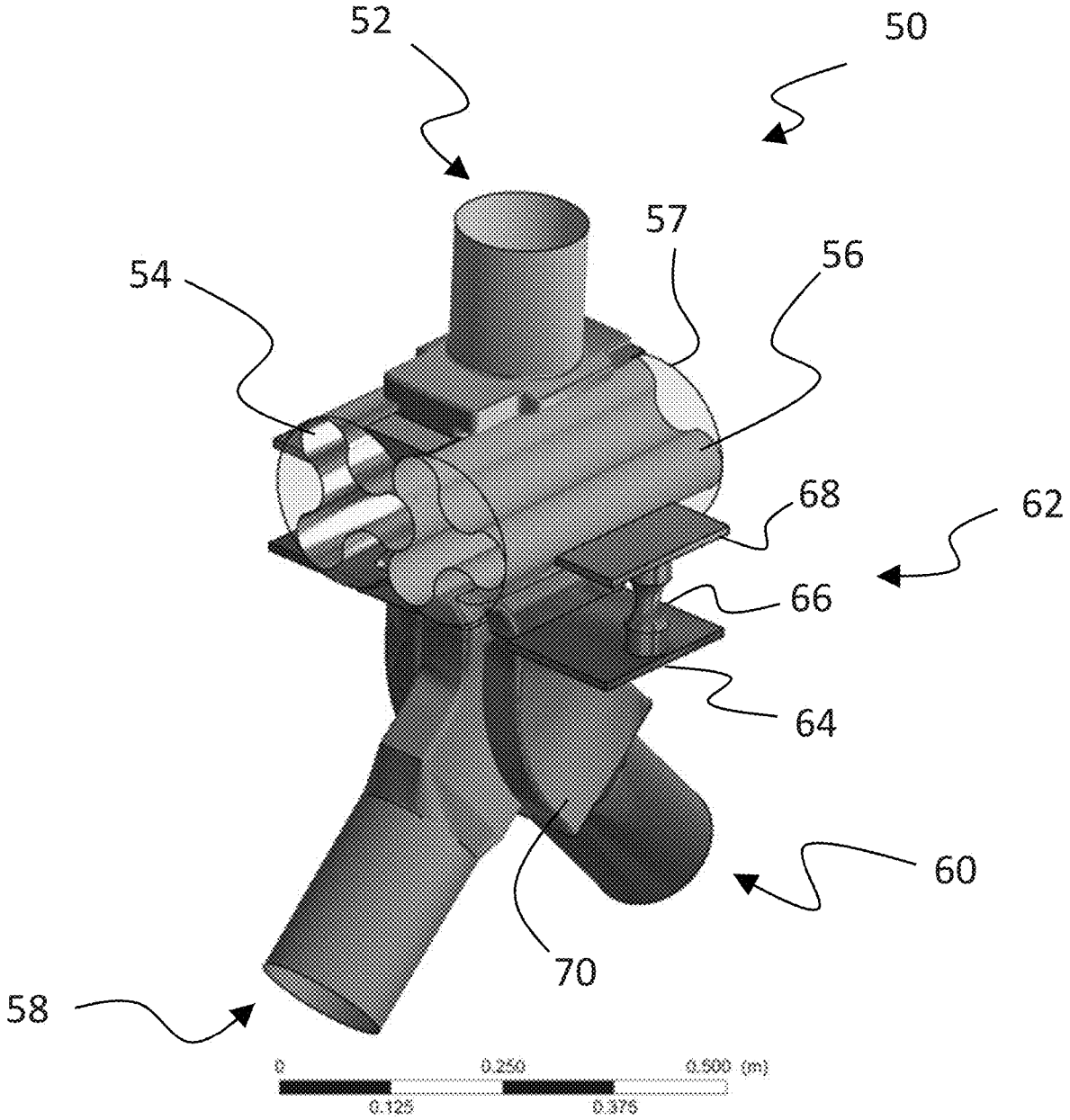
FIG. 2 depicts an embodiment of a vacuum roots blower having a pressure relief system.
Figure 3:
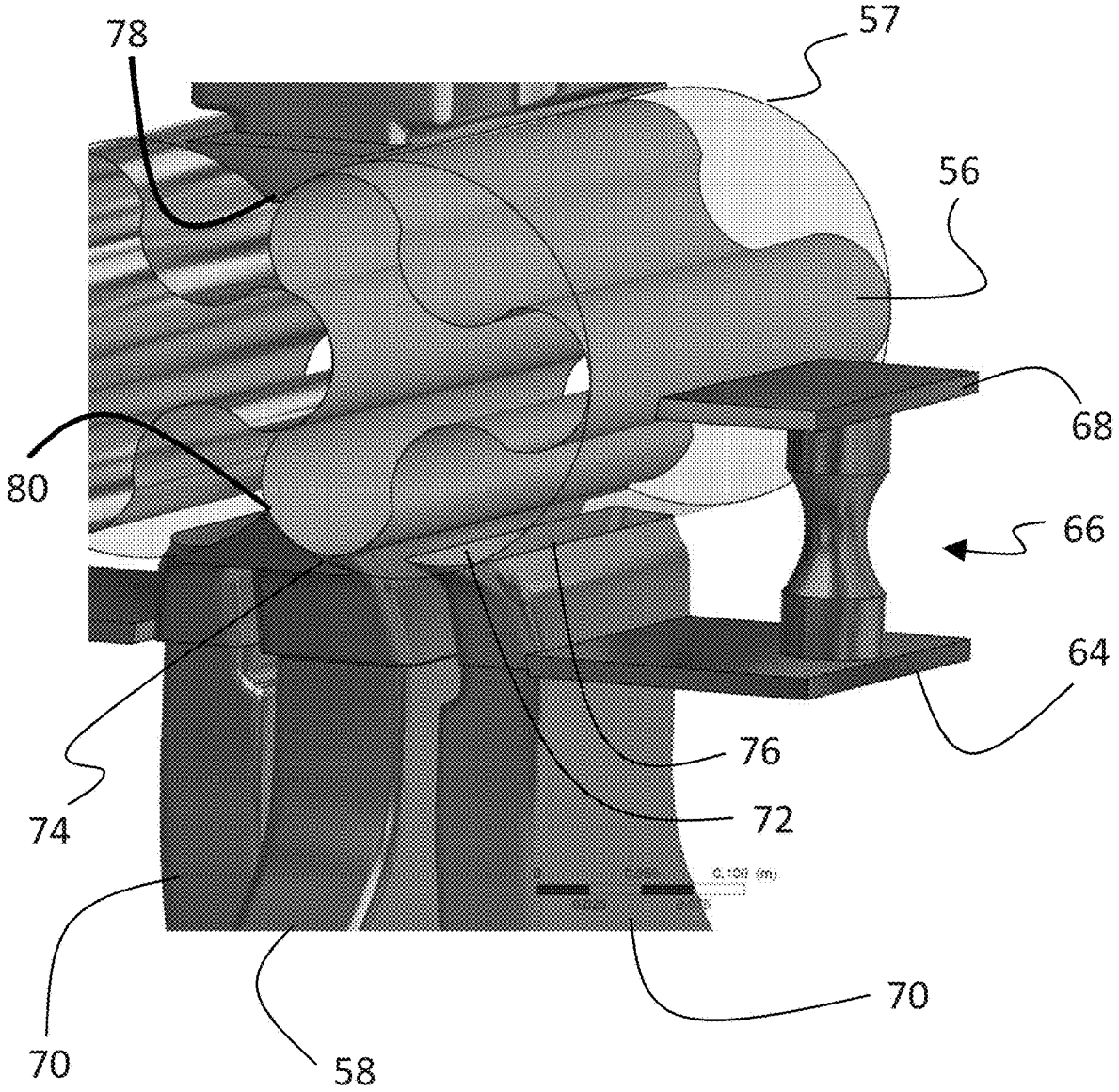
FIG. 3 depicts an embodiment of a vacuum roots blower having a pressure relief system.

Turning now to FIGS. 2 and 3, an embodiment of the instant application includes a pressure relief system 62 useful to provide a pre-injection of fluid into the trapped pocket prior to the pocket arriving at the outlet 58 (in those embodiments lacking a cooling air inlet 60) or the cooling air inlet 60 itself. The pre-injection of fluid into the rotating trapped pocket can assist in reducing the pressure differential between it and the outlet to the level at which any noise generated by the in rush of fluid is reduced and/or abated. In some forms the pressure relief can eliminate the difference in pressure entirely.

The pressure relief system 62 can include a pressure relief passage that flows a pressure relief fluid from a fluid origin and provides it to the trapped volume captured between the housing and the respective rotors. The illustrated embodiment depicts the pressure relief system 62 as including a fluid relief passage from the cooling air inlet 60, but other sources of pressure relief fluid are also contemplated. For example, the pressure relief fluid can originate from ambient, embodiments of which are described further below.

In the embodiment depicted in FIG. 2 the pressure relief system 62 includes an offtake 64, sonic passage 66, and injection port 68, but it will be appreciated that the pressure relief system 62 can take on a variety of shapes and sizes and may not include all of the components depicted in FIG. 2 as will be appreciated from the description herein. The pressure relief system 62 is used to provide an infill of pressure relief gas from a source (e.g. the cooling air 60) to one side of the vacuum roots blower 50 as the rotor 56 is rotated to expose a low pressure trapped pocket to the infilling pressure relief gas. Although the depiction in FIG. 2 shows only one side of the pressure relief system, it will be appreciated that many embodiments will include an analogous pressure relief system on the other side of the vacuum roots blower 50 such that pressure relief gas is provided to rotor 54 as well. Additionally, though the illustrated embodiment depicts just one pressure relief passage per side, some embodiments can include more than one pressure relief passage per side. For example, in those embodiments having four or five lobed rotors, additional pressure relief passages can be provided per side to increase to opportunities and range that fluid can be supplied to the pocket.

The cooling air inlet 60 can take the form of a single cooling fluid conduit which includes a bifurcation so as to direct cooling gas to either side of the vacuum roots blower 50. Such bifurcation can lead to separate cooling air passages 70 to each side of the vacuum blower 50. The cooling air passages 70 lead to a cooling air injection port 72 located near the outlet 74. The cooling air injection port 72 is typically located in proximity to the outlet and is used to reduce the temperature of fluid that is pulled from the inlet 52 to the outlet 58 by rotative action of the rotors 54 and 56. The opening 76 of the cooling air injection port 72 is can extend along all or a part of the axial length of the rotors 54 and 56. The opening can further extend circumferentially around the interior of the housing 57 any variety of arc distances. In one form the opening can be centered around the 6 o'clock position and extend over an arc length of 15 degrees, but other positions and extent of arc length are contemplated herein.

As used herein, descriptions which refer to clock positions (e.g. "6 o'clock") will be understood to be a clock position relative to the rotor 56 depicted in FIGS. 2 and 3 in which the rotor is rotating in the clockwise direction as viewed from the perspective of FIGS. 2 and 3. It will be appreciated that the rotor 54 rotates in a counter-clockwise direction, in which mirror images of the clock positions can be easily determined. The 12 o'clock position will be understood as the position determined by first drawing a reference line between the inlet side intersection 78 of the arc path swept by the rotor 54 and rotor 56 and the outlet side intersection 80 of the arc path swept by the rotor 54 and rotor 56. A secondary line is then drawn orthogonal to the reference line which represents the 3 o'clock-9 o'clock clock axis. A clock reference line is then drawn orthogonal from the secondary line and offset from the reference line, in which the clock reference line is drawn to locate the top most and bottom most part of the arc that the rotor 56 travels through. Although reference will be made herein to clock positions relative to rotor 56, it will be understood that straightforward transformations can be made to determine appropriate clock positions of the rotor 54.

In lieu of clock positions, reference may also be made herein using angular measurements. It will be appreciated that such angular measurements can either be absolute or relative measurements depending on the context, where the absolute angular measurements are referenced starting from the 12 o'clock positioned as determined above and which progresses in a clockwise direction. To set forth just a few non-limiting examples, 12 o'clock is the same as 0 degrees; 3 o'clock is the same as 90 degrees; 6 o'clock is the same as 180 degrees, etc.

The offtake 64 is structured to withdraw cooling air from the cooling air passage 70. Although the offtake 64 is shown as a passage having rectangular cross section extending at a high relative angle from a surface of the cooling air passage 70, other shapes and relative orientations are also contemplated herein. The offtake 64 can extend along the entire width of the cooling air passage 70 as depicted, but other shapes and sizes are also contemplated herein.

The cooling air injection port 68 is structured to provide air extracted by the offtake to a point for injection into the interior of the housing 57. Similar to the offtake 64, the cooling air injection port 68 is shown as a passage having rectangular cross section extending at a high relative angle from a surface of the housing 57. Other shapes and relative orientations are also contemplated herein. The cooling air injection port 68 can extend any distance along rotor 56, and in some forms may extend over less than the entire length of the rotor 56 as depicted in the illustrated embodiment. The port 68 can take on a variety of geometric cross sectional shapes. In some forms the port 68 can be a plurality of openings clustered generally in an elongate direction, each fed by one or more sonic passages 66, where such elongate direction can be along the length of rotor. The opening of the injection port 68 can extend along an axial distance that is shorter than an axial length of the rotor.

The cooling air injection port 68 can include an upstream edge formed in the housing 57 that starts around the 4 o'clock position and extends over an arc-length of 5 degrees, but other starting positions and extent of opening are contemplated herein.

Either or both of the offtake 64 and cooling air injection port 68 can include a variety of shapes, including but not limited to triangular, perforated holes, etc. Any suitable shape or shapes are contemplated to provide a suitable pre-injection rate.

Air withdrawn from the cooling air passage 70 via the offtake 64 is provided to the sonic passage 66 which is structured to produce a choked flow condition. The sonic passage 66 generally includes a narrowed cross section that produces the sonic choked flow condition. Such narrowed cross section can be a throat of a convergent-divergent (CD) nozzle, but other shapes are also contemplated. A shock wave can but need not occur in various positions in the CD nozzle depending on the flow conditions which may change during a fill duration of the pocket resulting in a location which changes during the fill. In one form the sonic passage 66 is a fixed geometry passage, but other embodiments can include variable area sonic passages. In one such form the cross sectional area of the sonic passage 66 can be modulated in a similar fashion to modulation of flow in a variable area valve. Thus, a valve handle can be provided in which a user can vary the cross sectional area of the sonic passage 66. In other forms a control system can be coupled with an actuator capable of varying the cross sectional area of the sonic passage. Such an actuator can be coupled to any suitable valving arrangement. The control system can be responsive to a sensor structured to detect sound or other vibrations. As will be appreciated, a sonic condition present in the sonic passage limits the mass flow therethrough and serves to locate the shock wave in the sonic passage 66 away from physical interaction with the rotor 56.

The narrow portion of the passageway which provides the sonic passage 66 can take a variety of forms beyond that depicted in the example CD nozzle. For example, the narrow portion, or throat, can be formed in the housing close to the opening to the chamber (e.g. the opening of the injection port 68) wherein such opening is elongate in orientation. Such embodiments may therefore dispense with the extended passage 68 depicted from one end of the sonic passage 66 to the housing and instead incorporate the sonic passage 66 as an elongated slit oriented in the direction of the rotor. Any variation of the sonic passage 66 and/or injection port 68 can be fed by any variety of pressure sources, whether ambient or via the cooling air inlet 60. The area of the narrow portion, or throat, will be understood to remain smaller than the area from which fluid is drawn from a fluid source (whether the cooling air inlet 60 or ambient, etc) to ensure acceleration of air to the sonic condition required to form a choked flow.

The opening through which port 68 injects gas into the interior of the rotor cavity can be preceded by any number of passageway configurations. In one form the pressure relief opening is preceded by a convergent-divergent valve (CD valve) positioned upstream of the opening as illustrated. The CD valve can be a continuously convergent and continuously divergent valve in some embodiments, but in other forms the CD valve need not be smoothly continuous in either the upstream or downstream sections. In some forms the pressure relief opening can be a step transition where the shock forms in proximity to the outlet. In embodiments in which the sonic passage 66 is a Venturi, some forms contemplate two or more sonic passages 66 in serial connection with each other. Some embodiments can include Venturi passages in parallel with each other to provide infill gas to a common pocket as the rotors are being rotated. In lieu of a Venturi, a cylinder with a small diameter middle section may also be used.

The scales depicted in FIGS. 1-3 are representative of possible dimensions of the devices depicted. It will be appreciated that other dimensions and/or shapes/configurations of FIGS. 2-3 are possible in other embodiments.

Turning now to FIGS. 4-16, and 17-29, various computational results are shown comparing the operation of a prior art vacuum roots blower 50 and an embodiment of the instant application having a pressure relief system 62. On each page the prior art roots blower is illustrated on the bottom, while an embodiment of the vacuum roots blower 50 of the instant application is shown on the top. It will be appreciated that the views have been rotated relative to the configuration shown in FIGS. 1-3. On the left side of each blower is shown the inlet, while on the right side is shown the outlet and cooling air inlets. FIGS. 4-16 illustrate pressure contours starting at a relative angle of 0 degrees of the rotors in FIG. 4 and progressing in 10 degree increments throughout the remainder of FIGS. 5-16. FIGS. 17-29 illustrate Mach contours starting at a relative angle of 0 degrees of the rotors in FIG. 17 and progressing in 10 degree increments throughout the remainder of FIGS. 18-29. The angle measurements shown in FIGS. 4-29 are for convenience of illustration and do not correspond precisely to the measurements provided herein with respect to location of inlets and outlets as will be understood in the context of the description. In other words, 0 degrees in FIG. 4 does not correspond to the 12 o'clock position described above.

Figure 4:
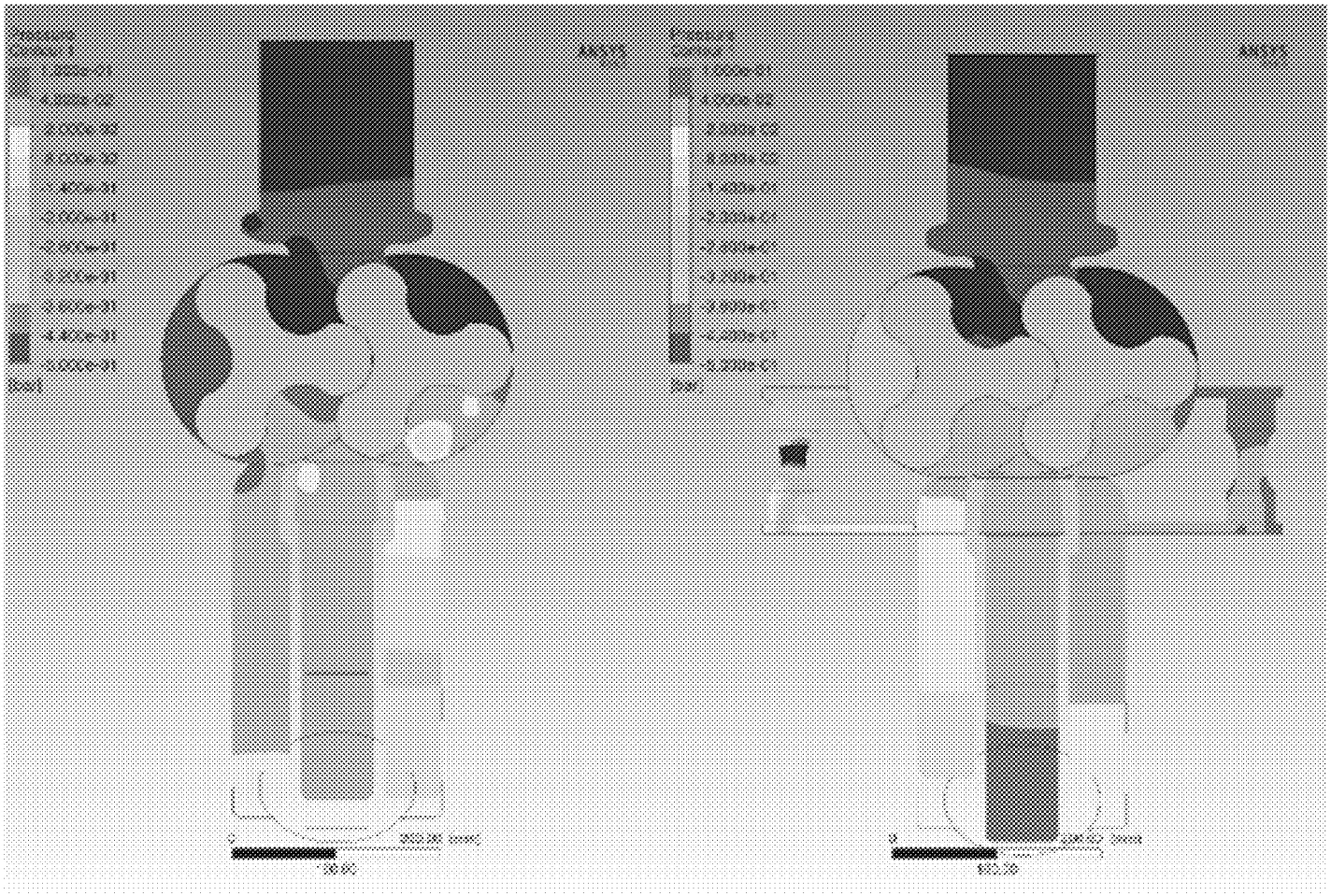
FIG. 4 illustrates operation of a pressure relief system.
Figure 5:
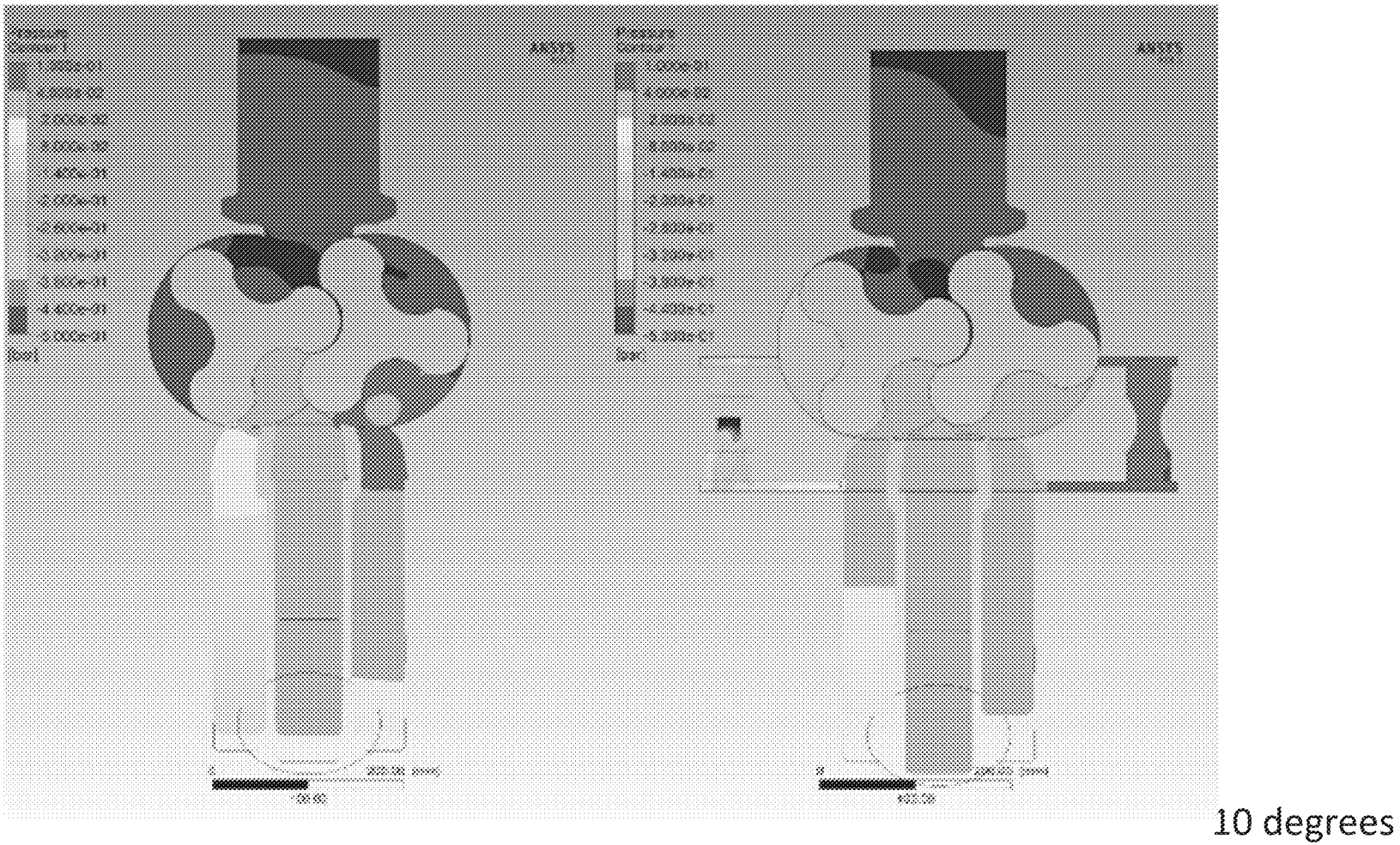
FIG. 5 illustrates operation of a pressure relief system.
Figure 6:
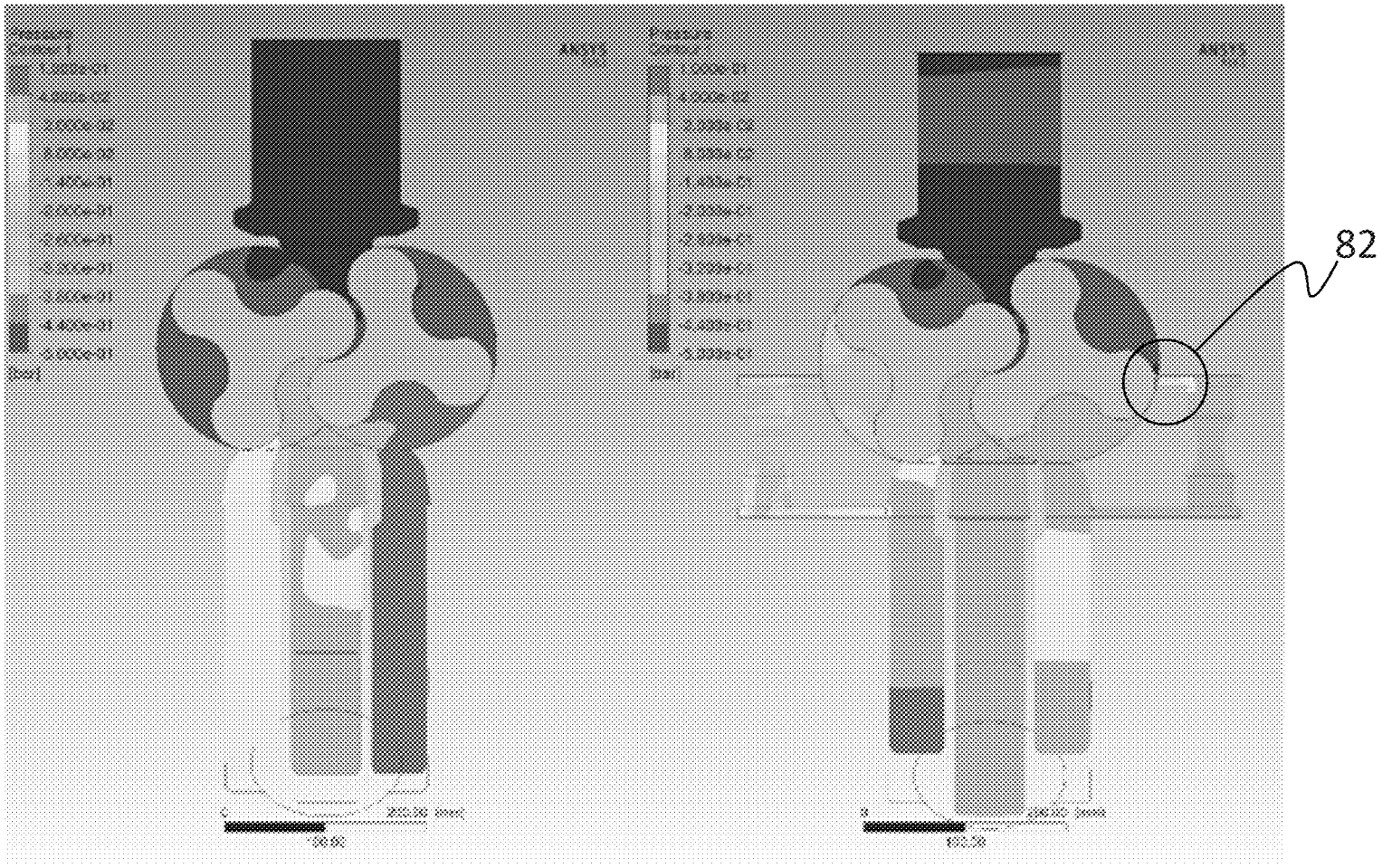
FIG. 6 illustrates operation of a pressure relief system.
Figure 7:
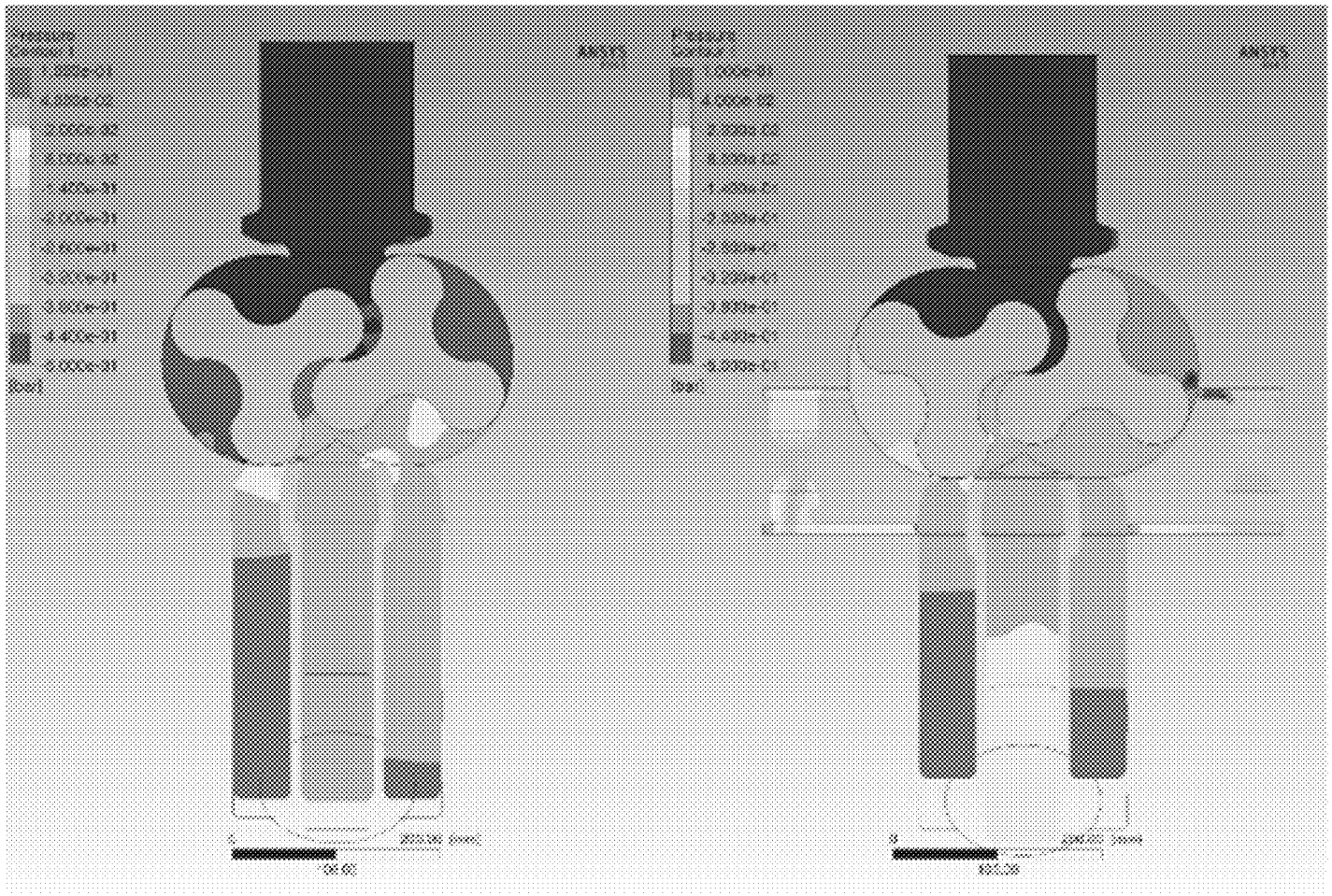
FIG. 7 illustrates operation of a pressure relief system.
Figure 8:
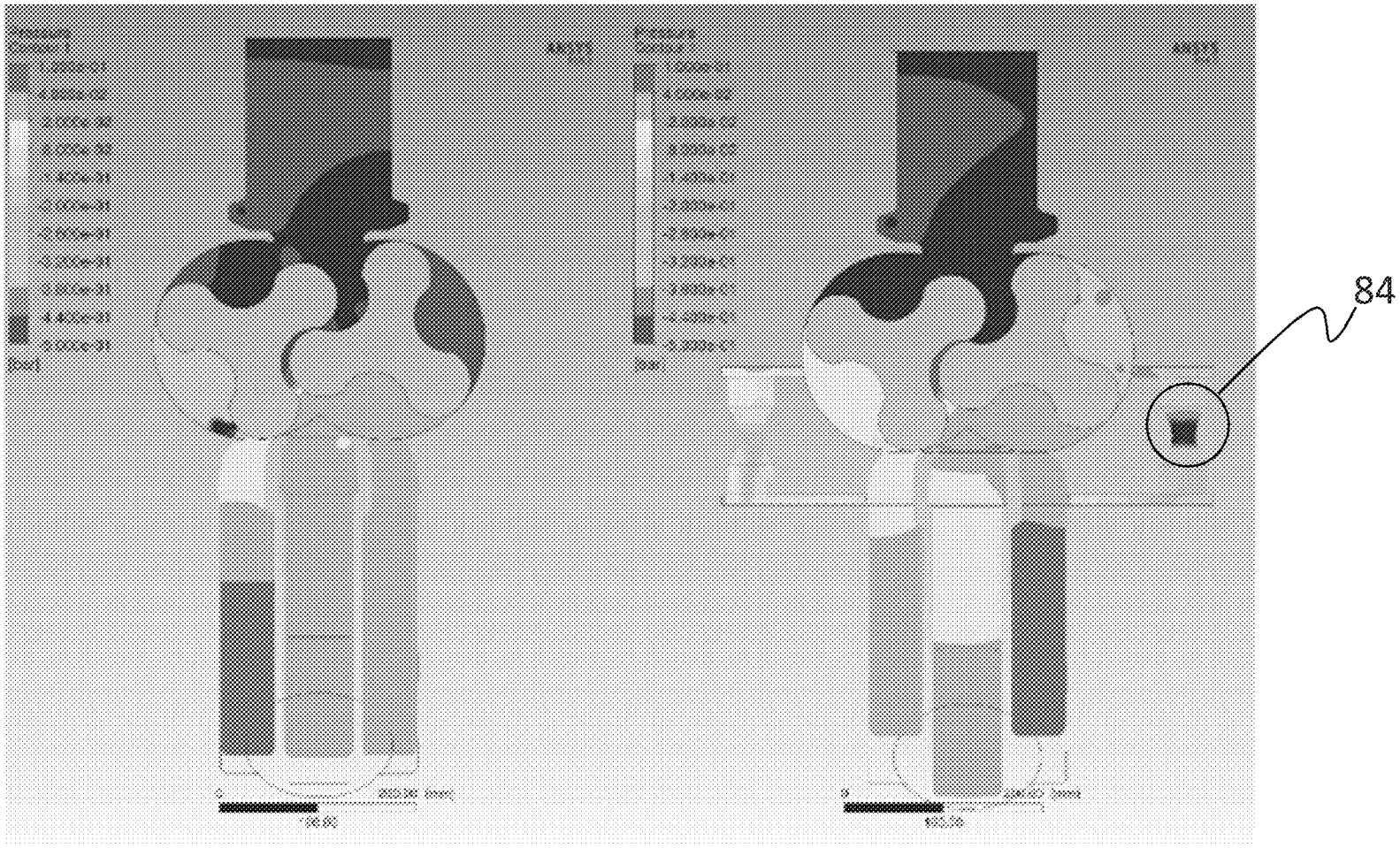
FIG. 8 illustrates operation of a pressure relief system.
Figure 9:
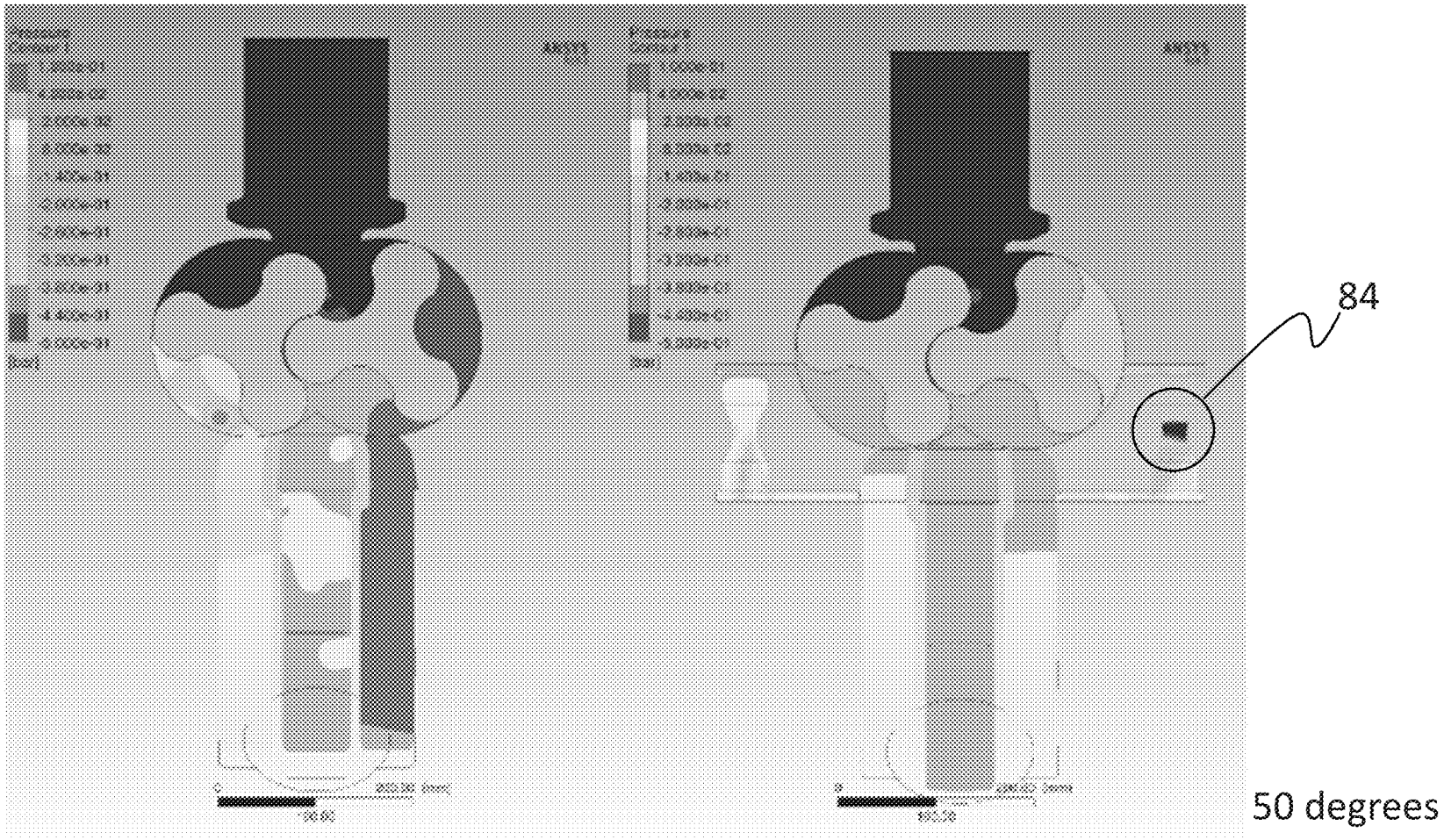
FIG. 9 illustrates operation of a pressure relief system.
Figure 10:
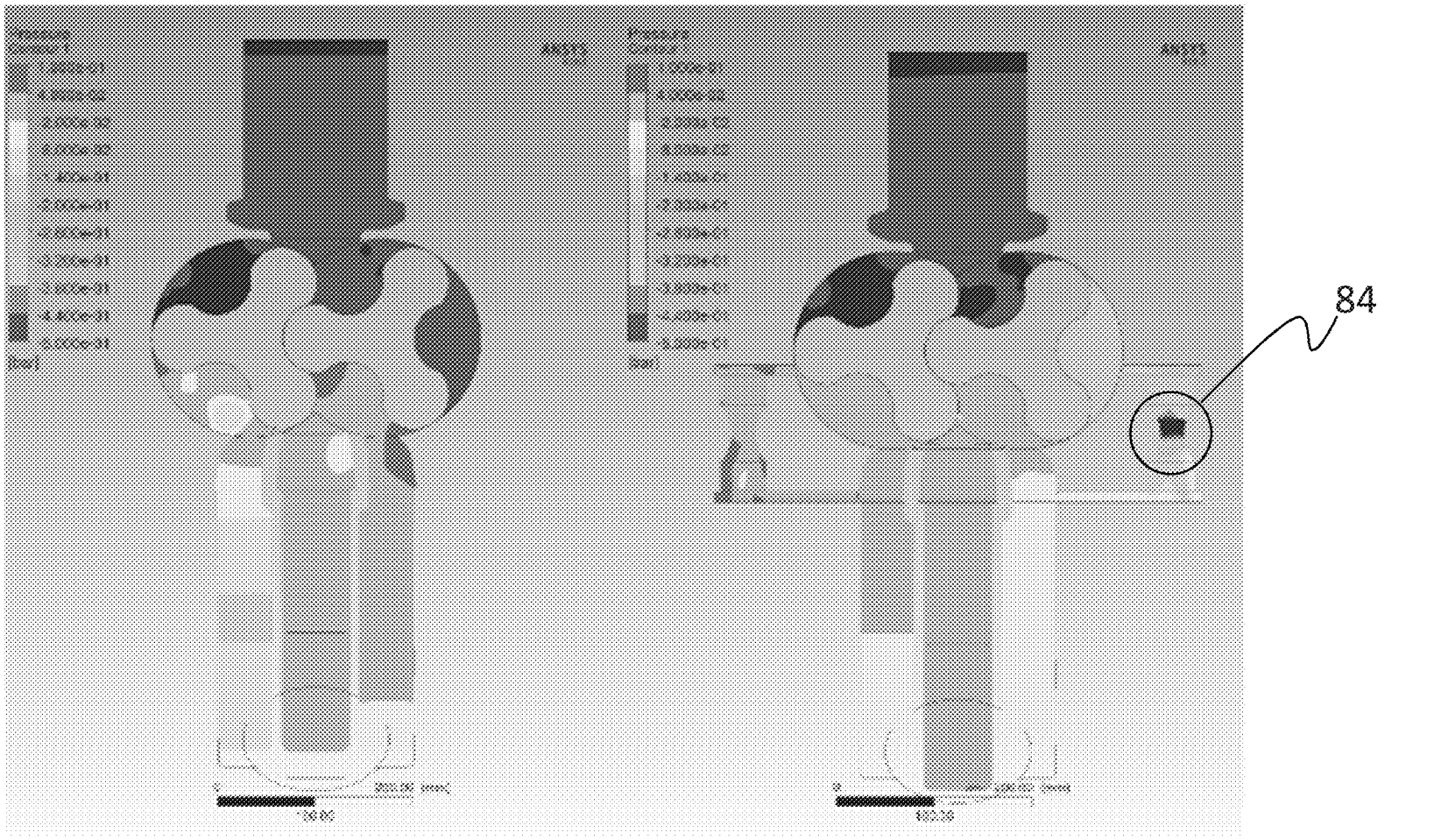
FIG. 10 illustrates operation of a pressure relief system.
Figure 11:
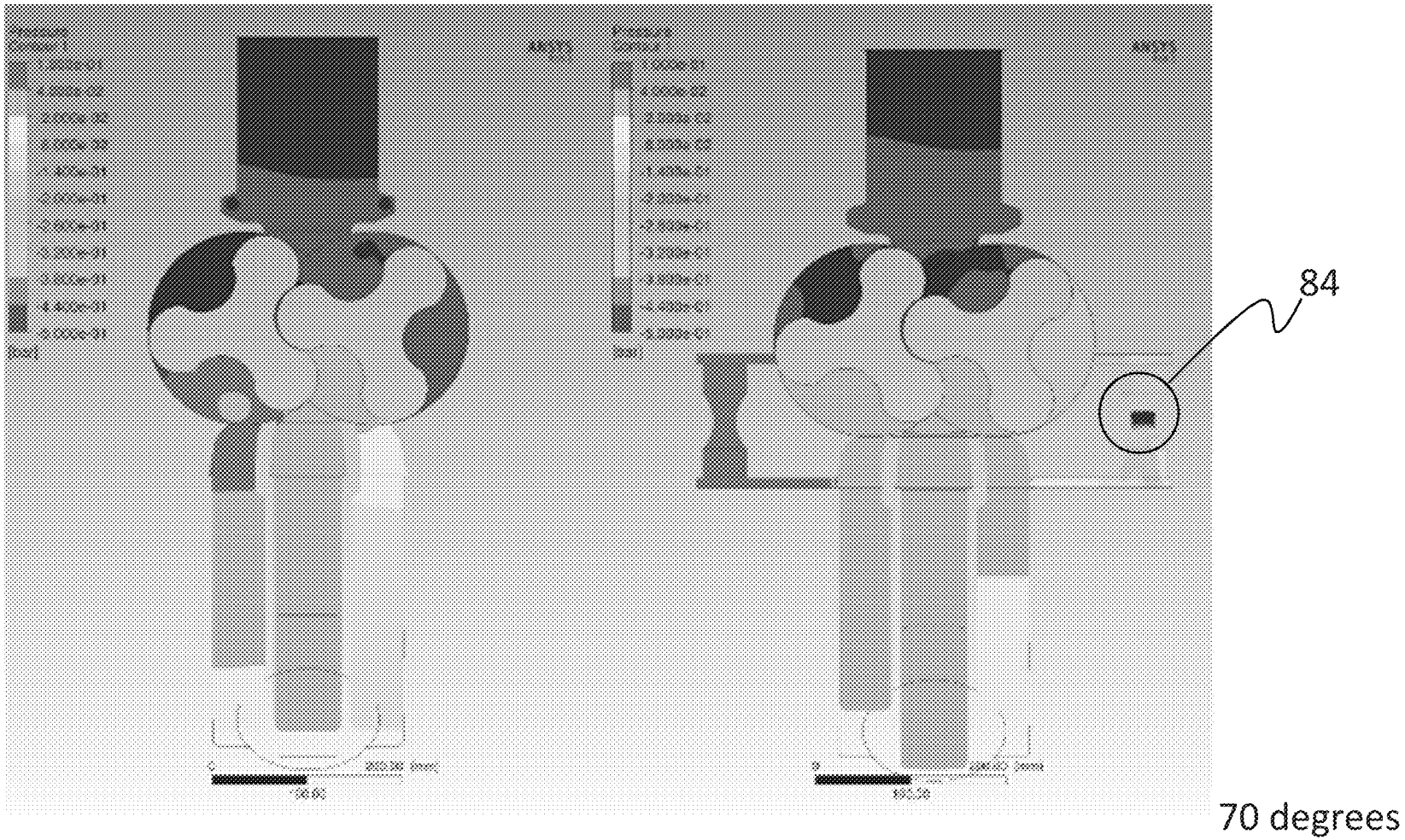
FIG. 11 illustrates operation of a pressure relief system.
Figure 12:
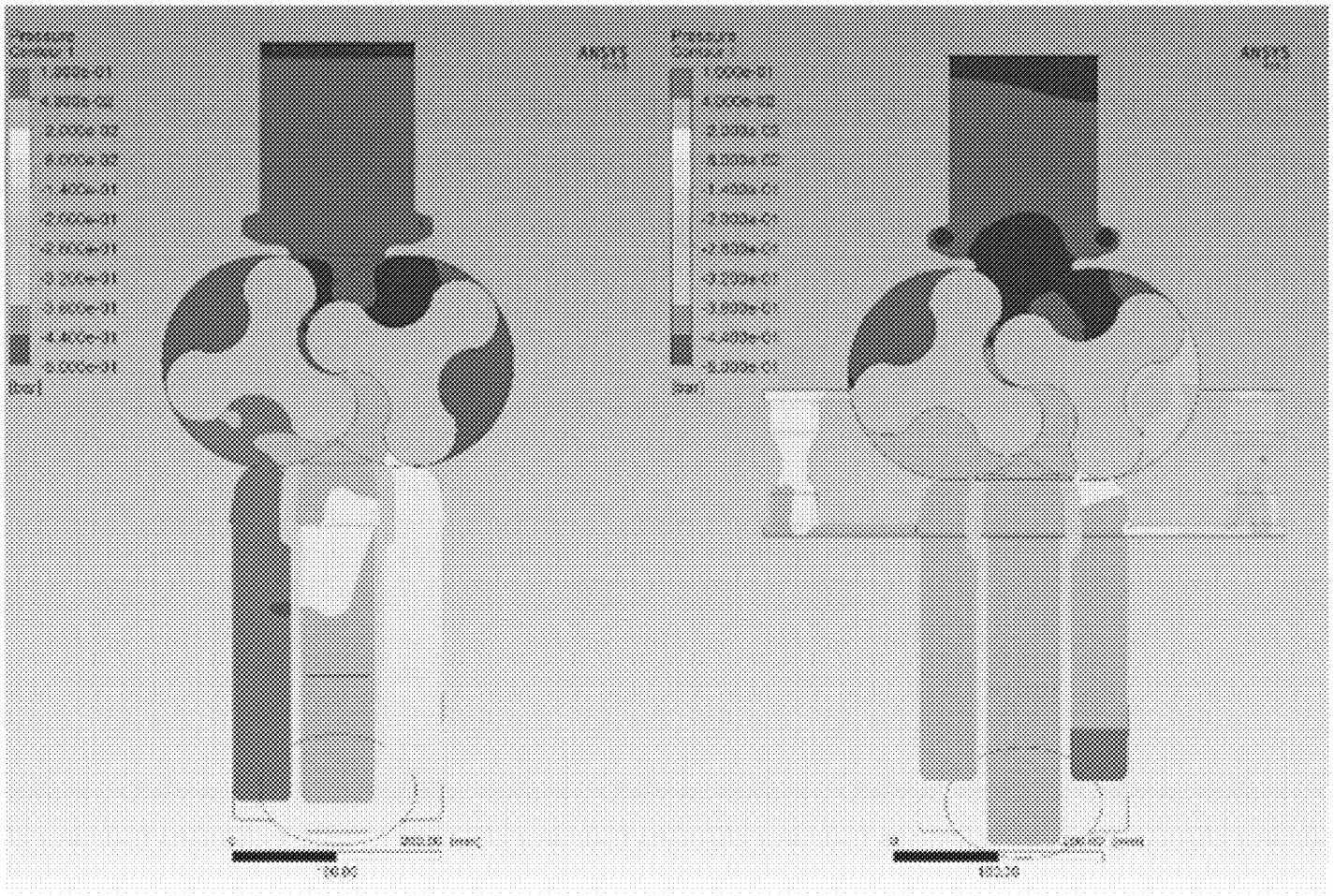
FIG. 12 illustrates operation of a pressure relief system.
Figure 13:
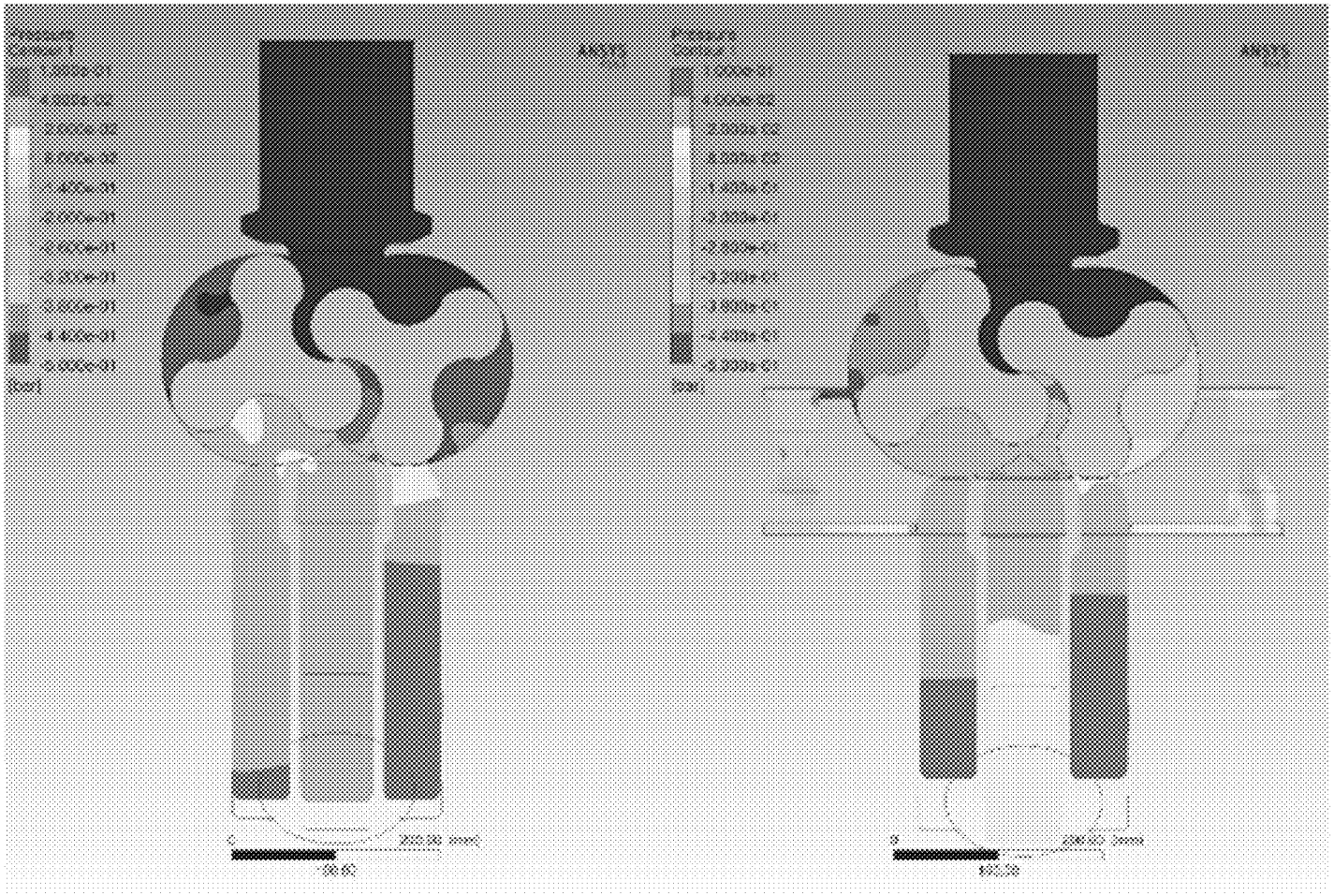
FIG. 13 illustrates operation of a pressure relief system.
Figure 14:
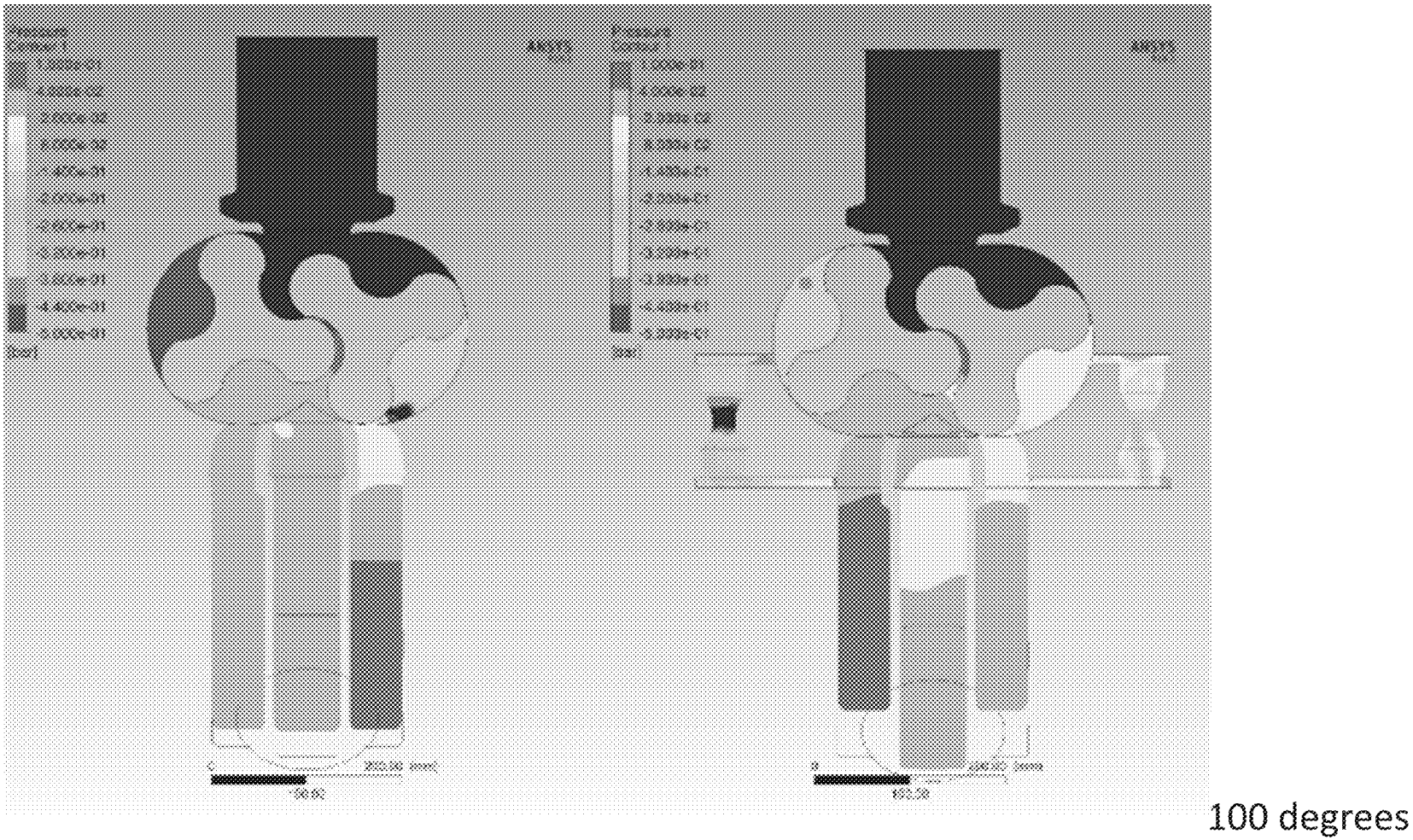
FIG. 14 illustrates operation of a pressure relief system.
Figure 15:
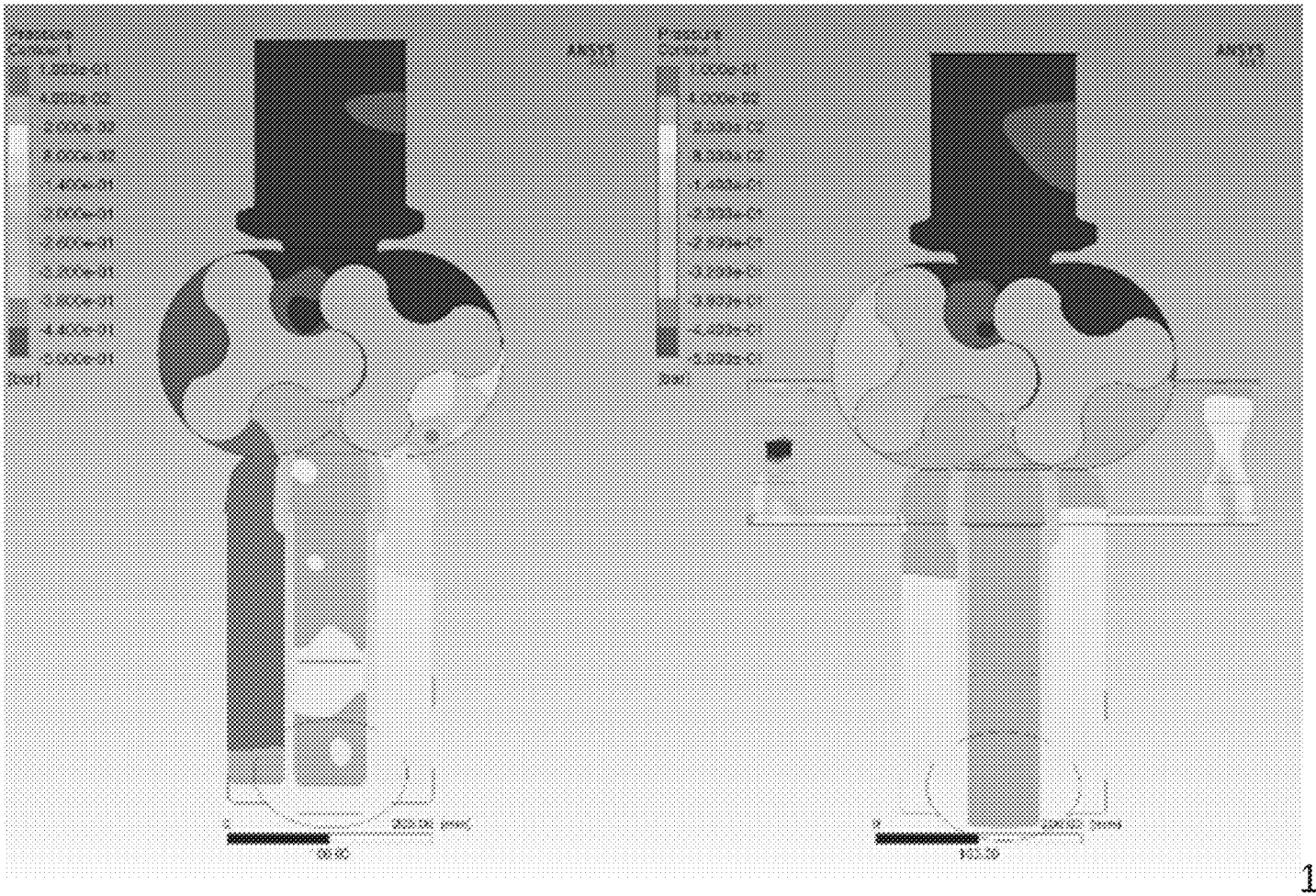
FIG. 15 illustrates operation of a pressure relief system.
Figure 16:
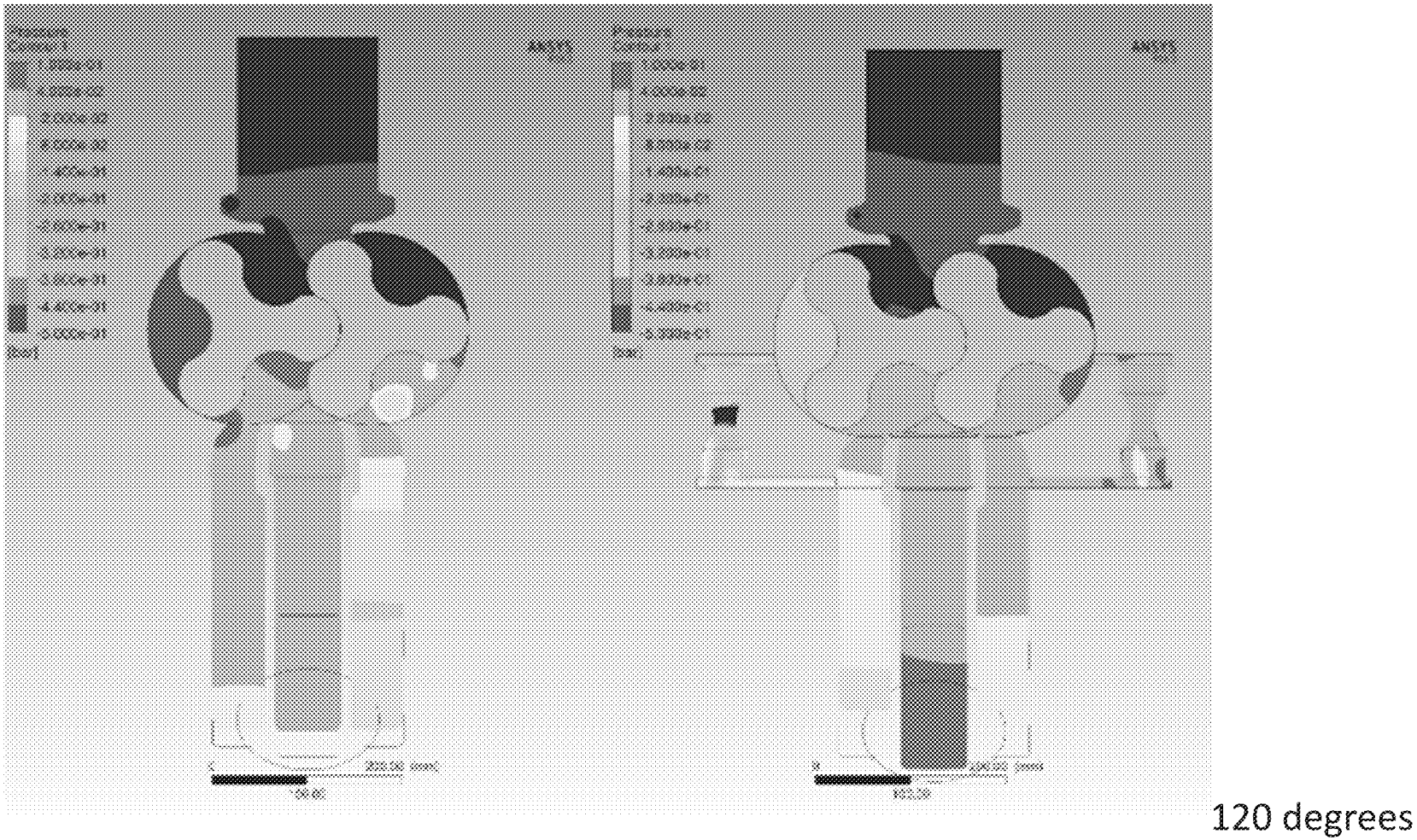
FIG. 16 illustrates operation of a pressure relief system.

The 0 degrees indication in FIG. 4 illustrates a position in which the rotor 56 is about to sweep past the inlet 52 and thereby close off and form a pocket between adjacent lobes of the rotor 56 which will be moved to the outlet 58 upon further rotation of the rotor 56. Once the pocket is rotated to the outlet 58 any residual gas within the pocket can be vented, before the rotor 56 is rotated into intermeshed engagement with rotor 54 and the process begins anew. It will be appreciated that the pocket can be at a similar pressure to pressure of gas at the outlet 74 in some modes of operation, while in other modes of operation the pressure in the pocket can be lower than pressure of a gas at the outlet 74. When pressure in the pocket is lower than pressure at the outlet 74 a gas infilling process will occur into the pocket. FIG. 5 illustrates a position in which the pocket is closed off from both the inlet 52 and from the pressure relief injection port 68. Such a position intermediate between the inlet 52 and port 68 is envisioned in many embodiments herein, but alternative embodiments are also contemplated. FIG. 6 depicts a rotational position of rotor 56 where the pocket is initially opened to the injection port 68 where pressure relief gas can begin filling in to the pocket. Feature 82 illustrates a change in pressure through the injection port 68 which indicates an infilling process. FIG. 7 illustrates the continuation of infilling of the pocket through the pressure relief system 62.

FIGS. 8-11 illustrate low pressure at the throat of the sonic passage 66 as gas reaches its mass flow rate limit through the passage 66 as a result of the area ratio. Feature 84 illustrates the low pressure as a dark banded region at the throat of the sonic passage 66. The area at the throat of the sonic passage 66 will be smaller than the area immediately upstream of the throat to ensure subsonic flow is accelerated to cause the flow to choke. FIGS. 12-16 illustrate further rotation of the rotor 56 in which gas is infilling to the pocket but without formation of a sonic condition or shock at the throat of the sonic passage 66 due to the falling pressure difference between the pocket and the injection port 68 as a result of the movement of gas to the pocket. Although the sonic or shock formation process is shown as occurring from 40-70 degrees in the illustrated embodiment, it will be appreciated that such sonic or shock formation can occur over larger or smaller ranges dependent upon initial pressure in the pocket, relative area of the sonic passage 66 as compared to the initial area of flow (e.g. the initial upstream area of the sonic passage 66 when it takes the form of a CD nozzle), and the pressure at the initial area of flow. In some cases sonic or shock formation can additionally be dependent upon rotor speed. In the case of a variable area sonic passage 66, sonic or shock formation can be varied as the cross sectional area is varied.

Figure 17:
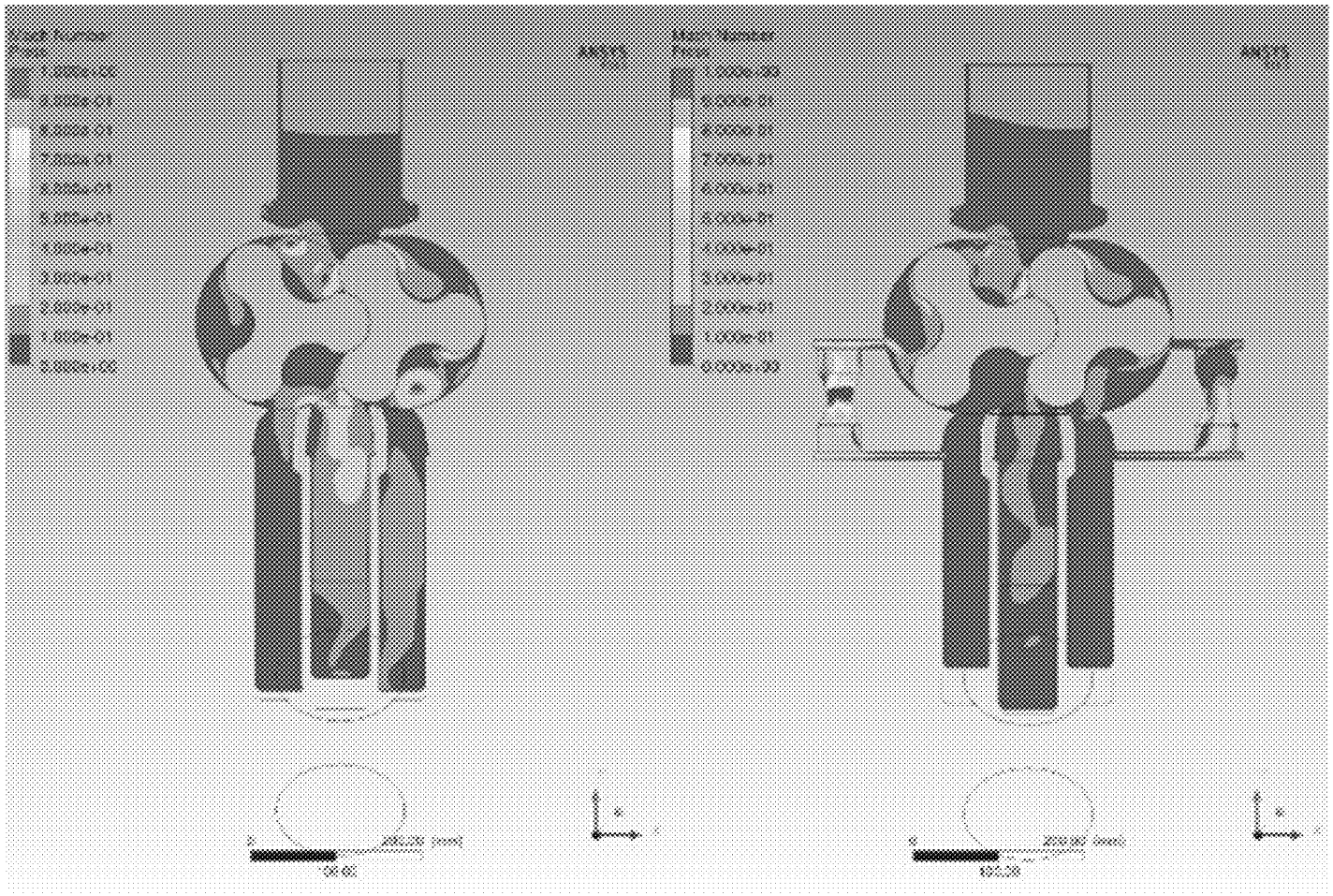
FIG. 17 illustrates operation of a pressure relief system.
Figure 18:
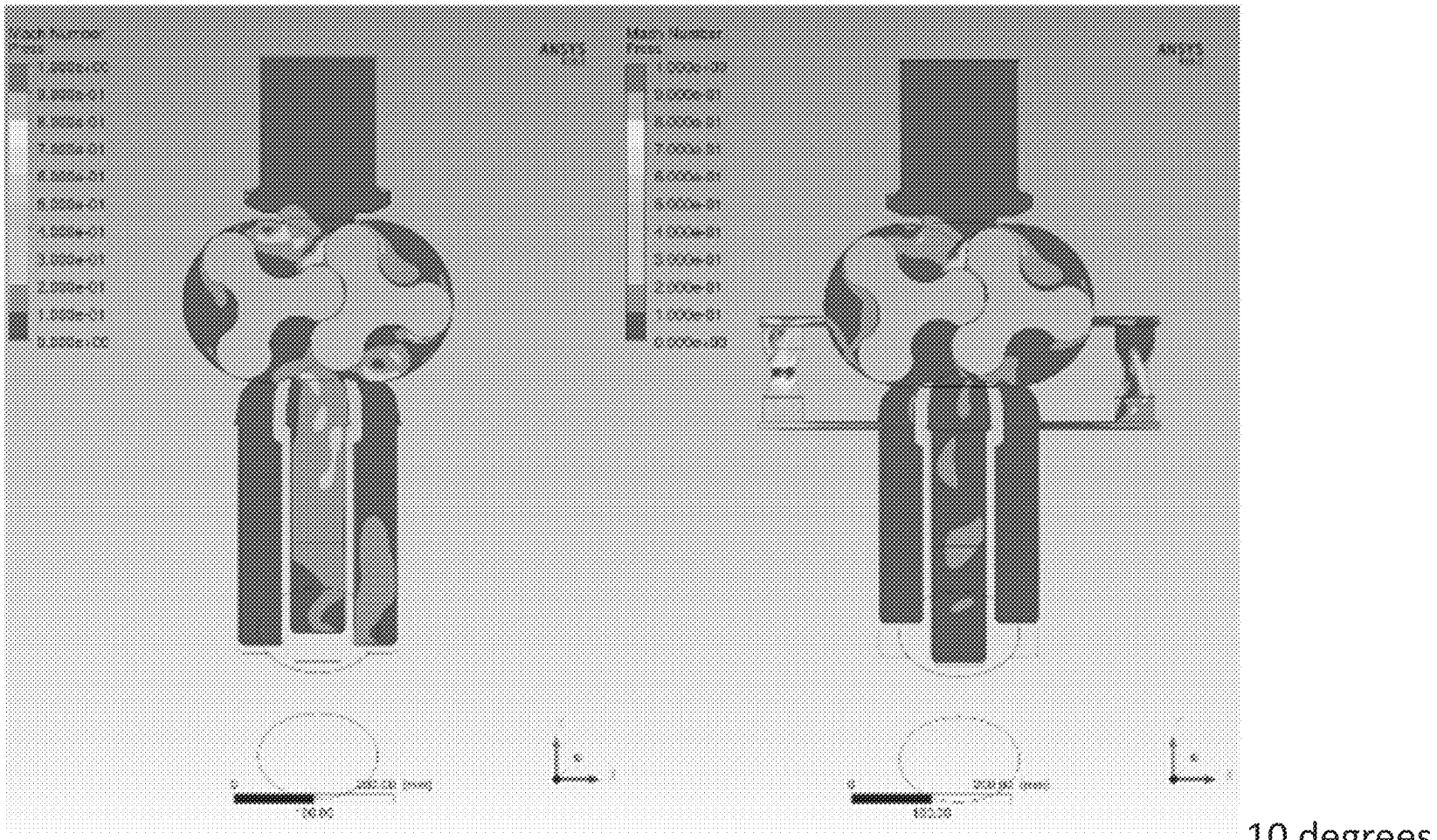
FIG. 18 illustrates operation of a pressure relief system.
Figure 19:
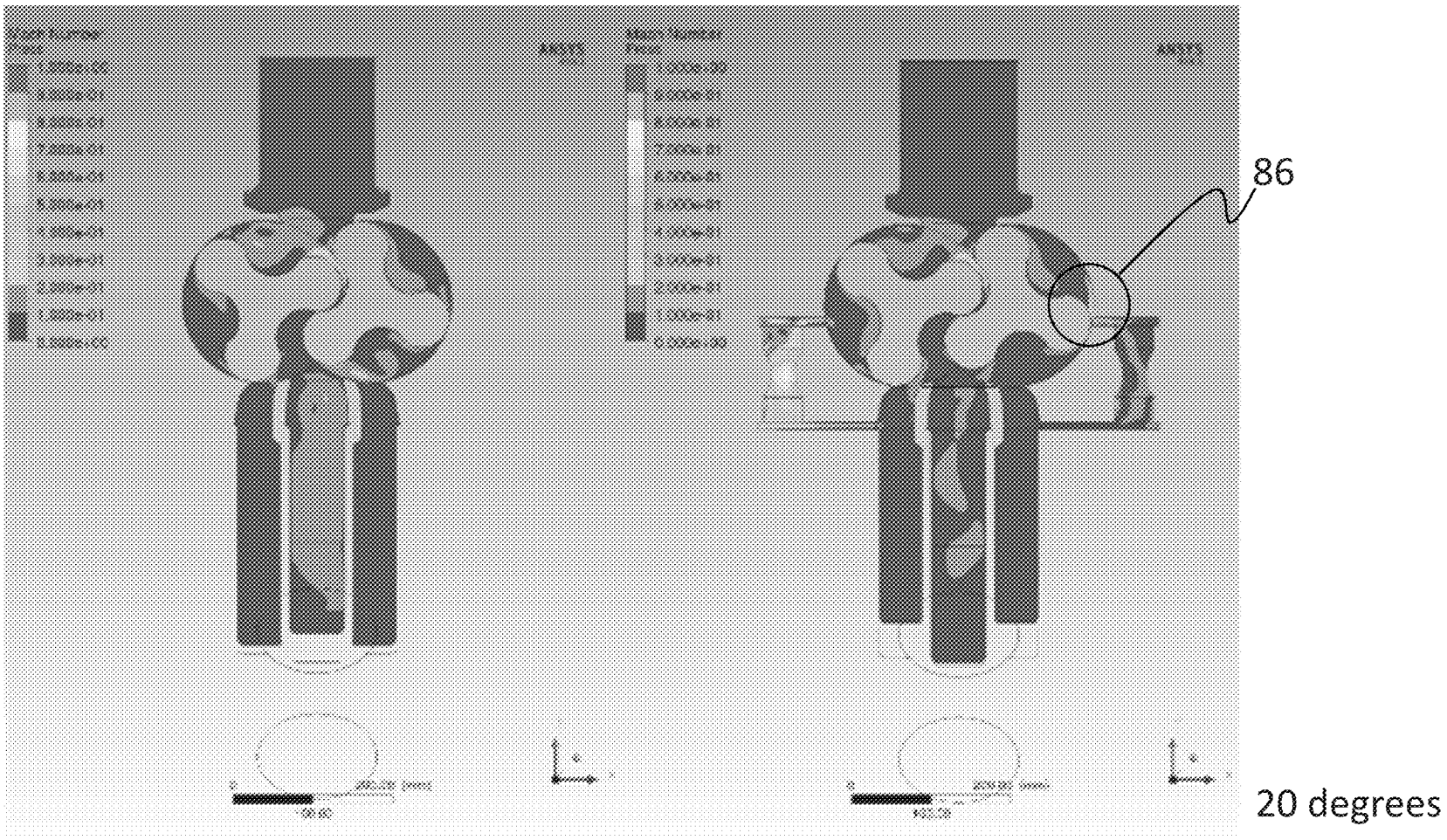
FIG. 19 illustrates operation of a pressure relief system.
Figure 20:
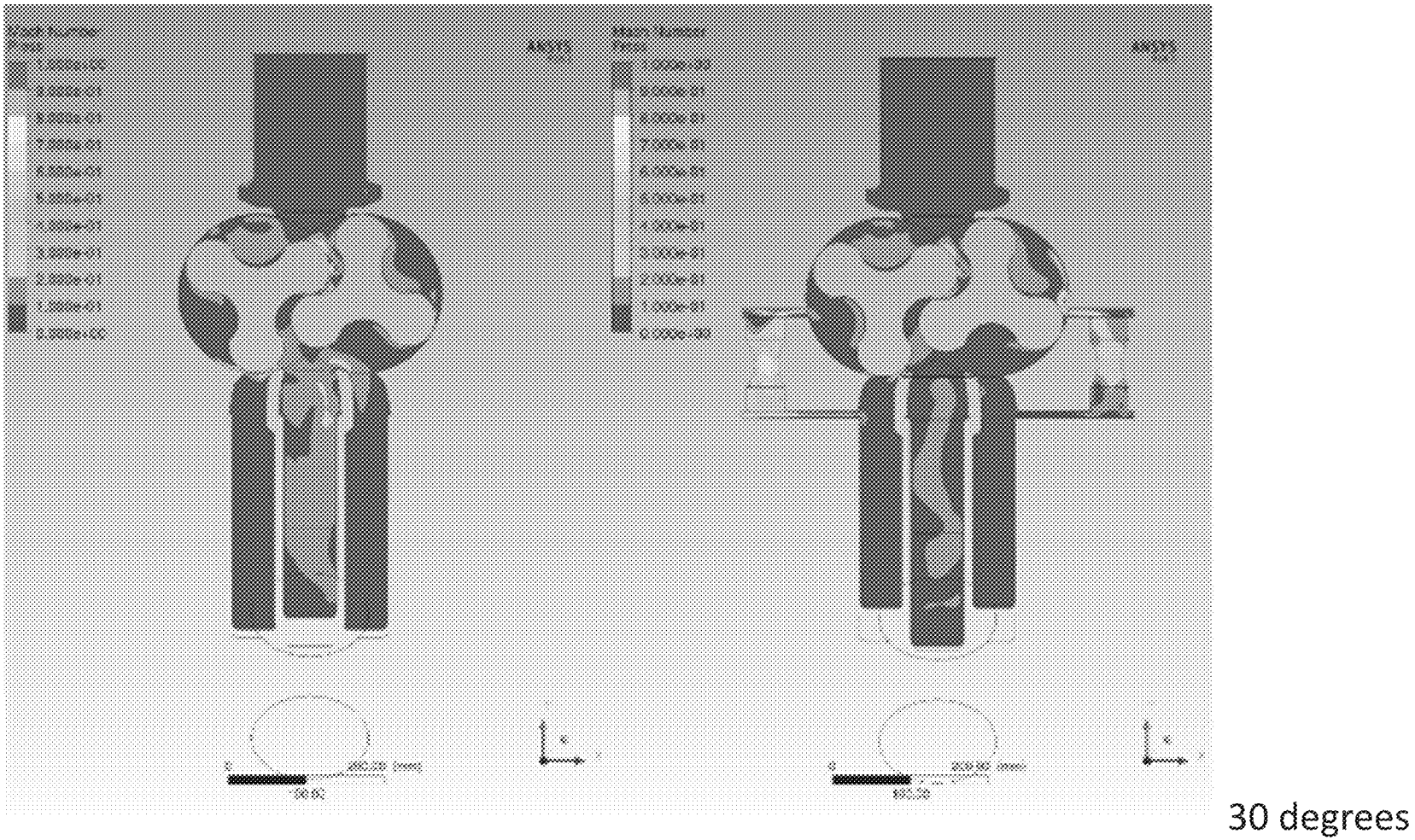
FIG. 20 illustrates operation of a pressure relief system.
Figure 21:
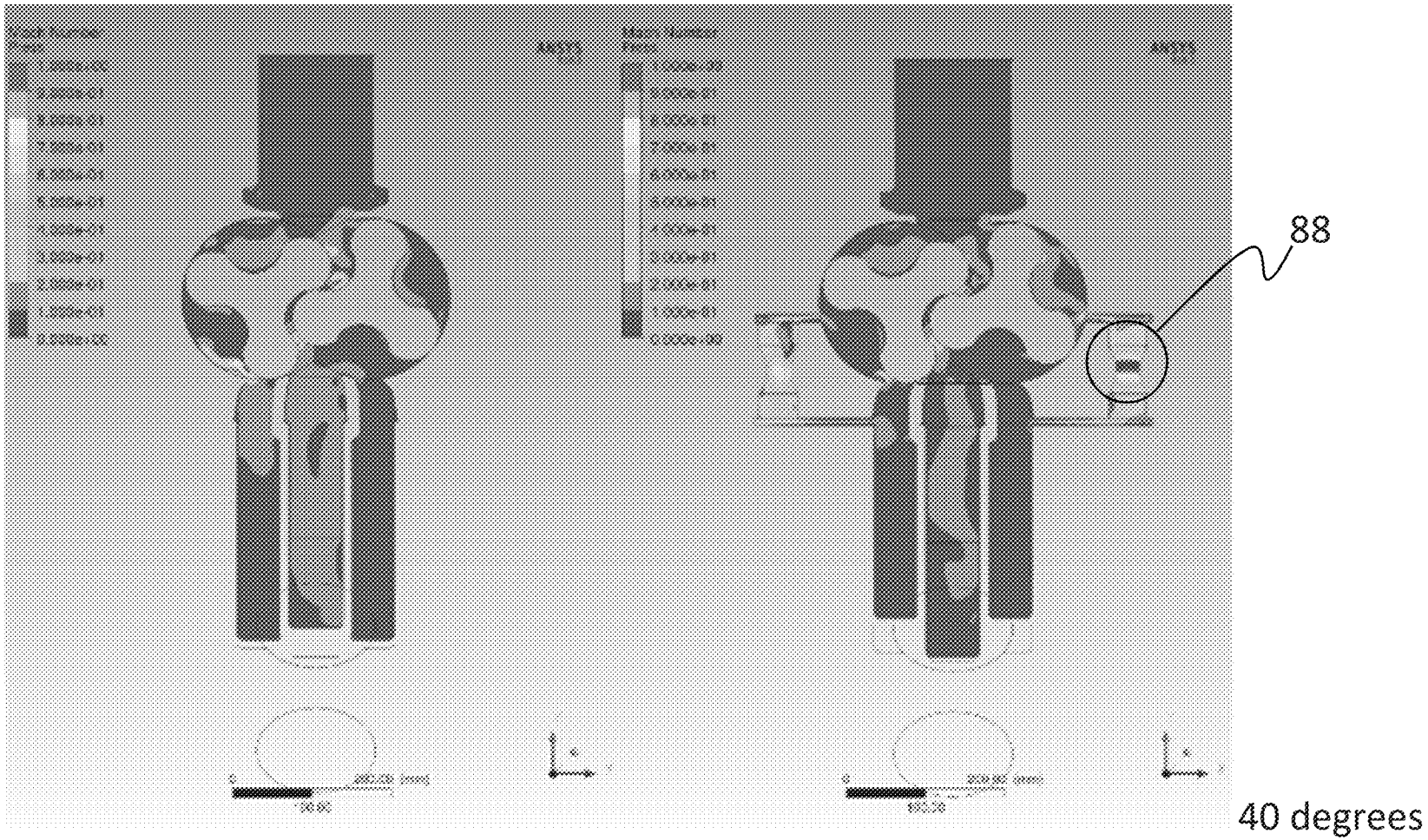
FIG. 21 illustrates operation of a pressure relief system.
Figure 22:
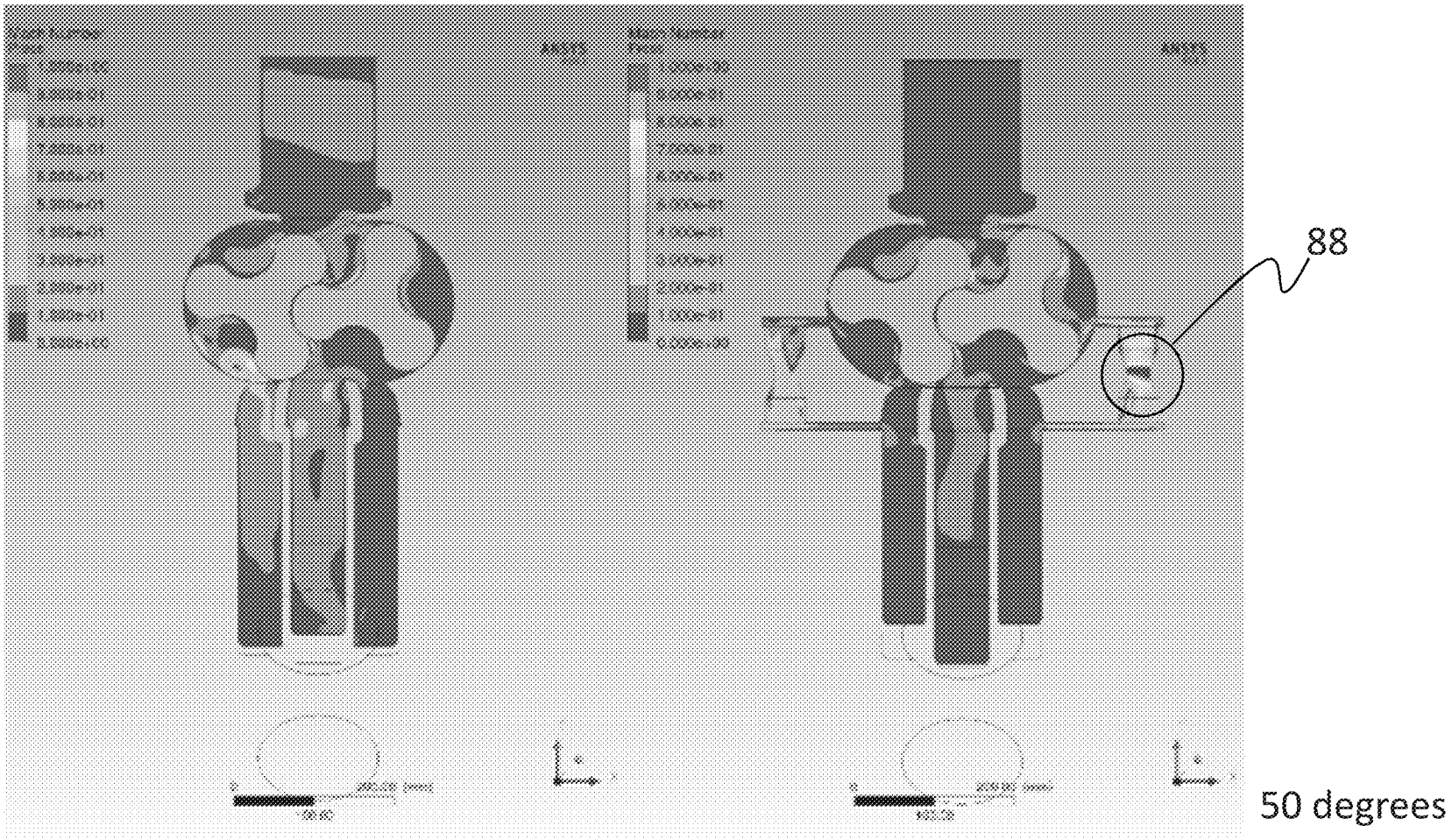
FIG. 22 illustrates operation of a pressure relief system.
Figure 23:
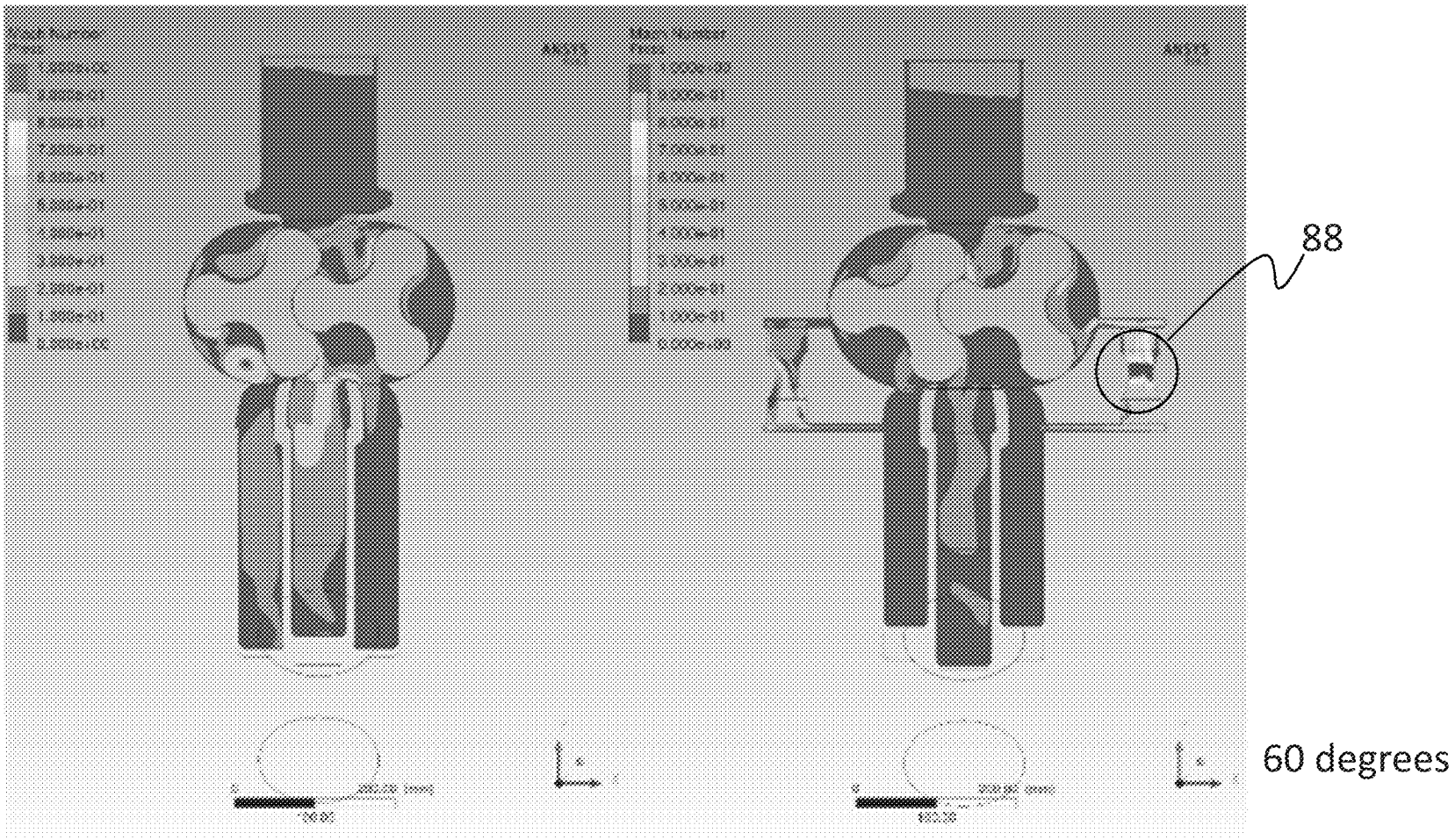
FIG. 23 illustrates operation of a pressure relief system.
Figure 24:
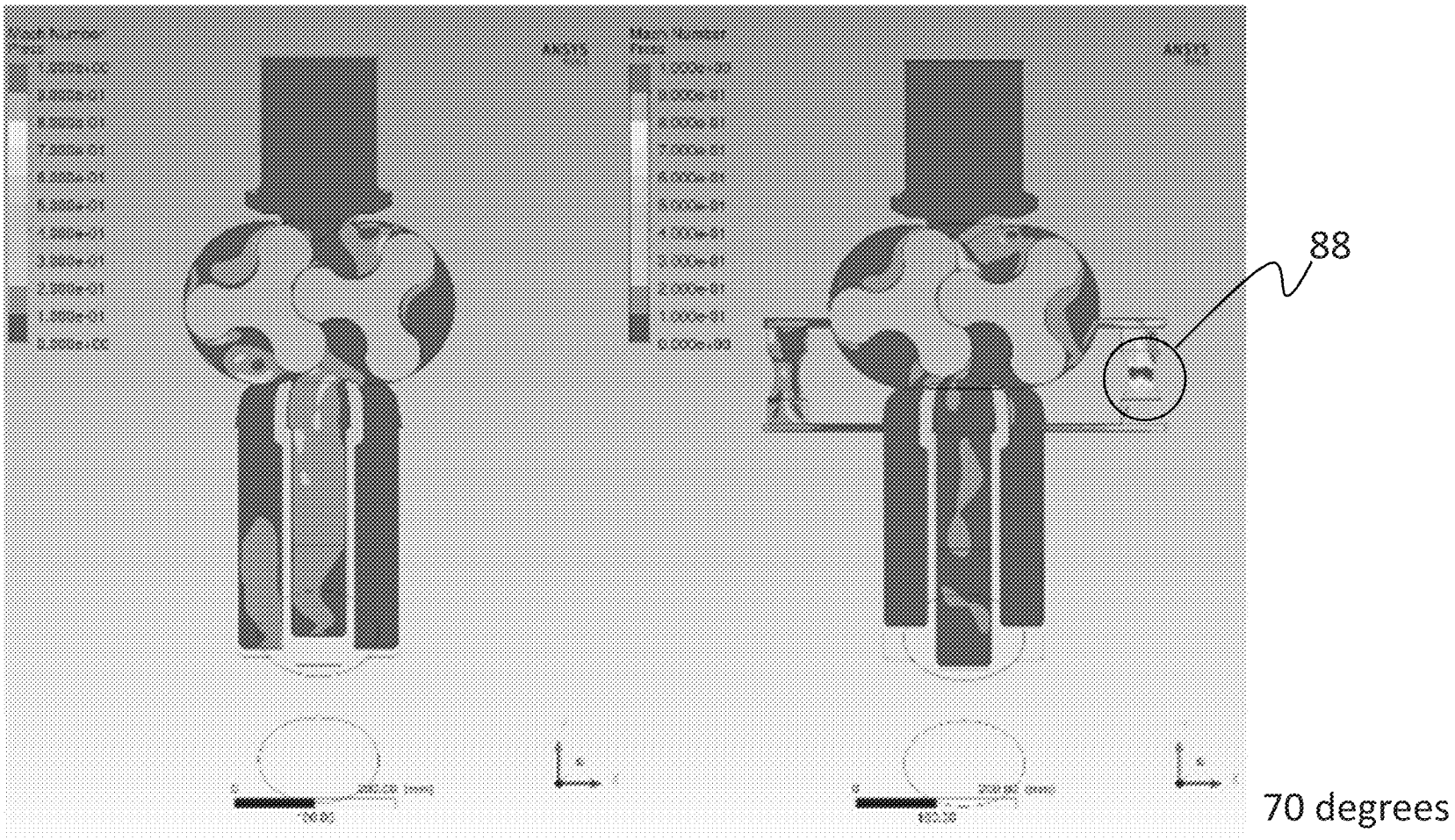
FIG. 24 illustrates operation of a pressure relief system.
Figure 25:
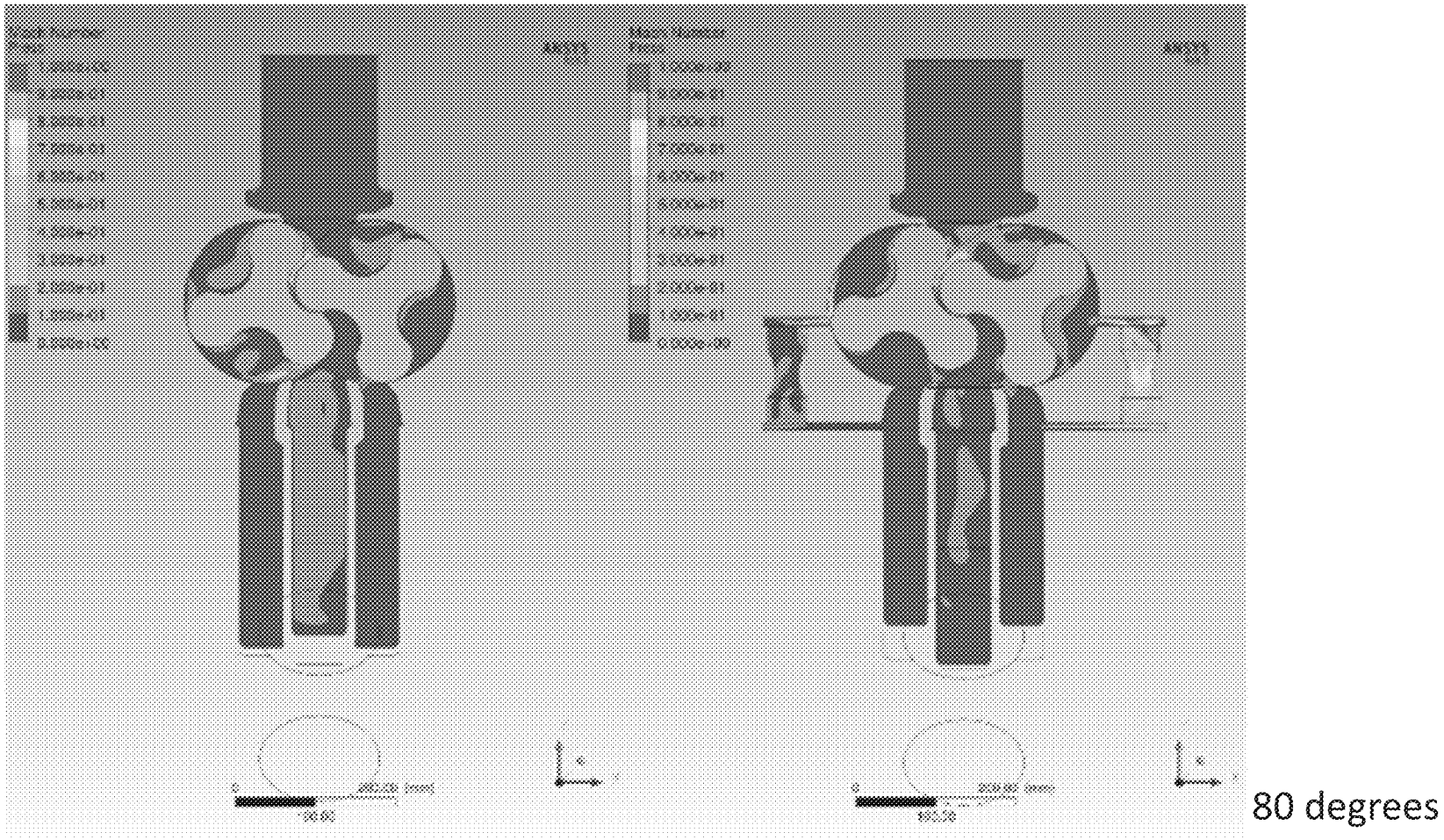
FIG. 25 illustrates operation of a pressure relief system.
Figure 26:
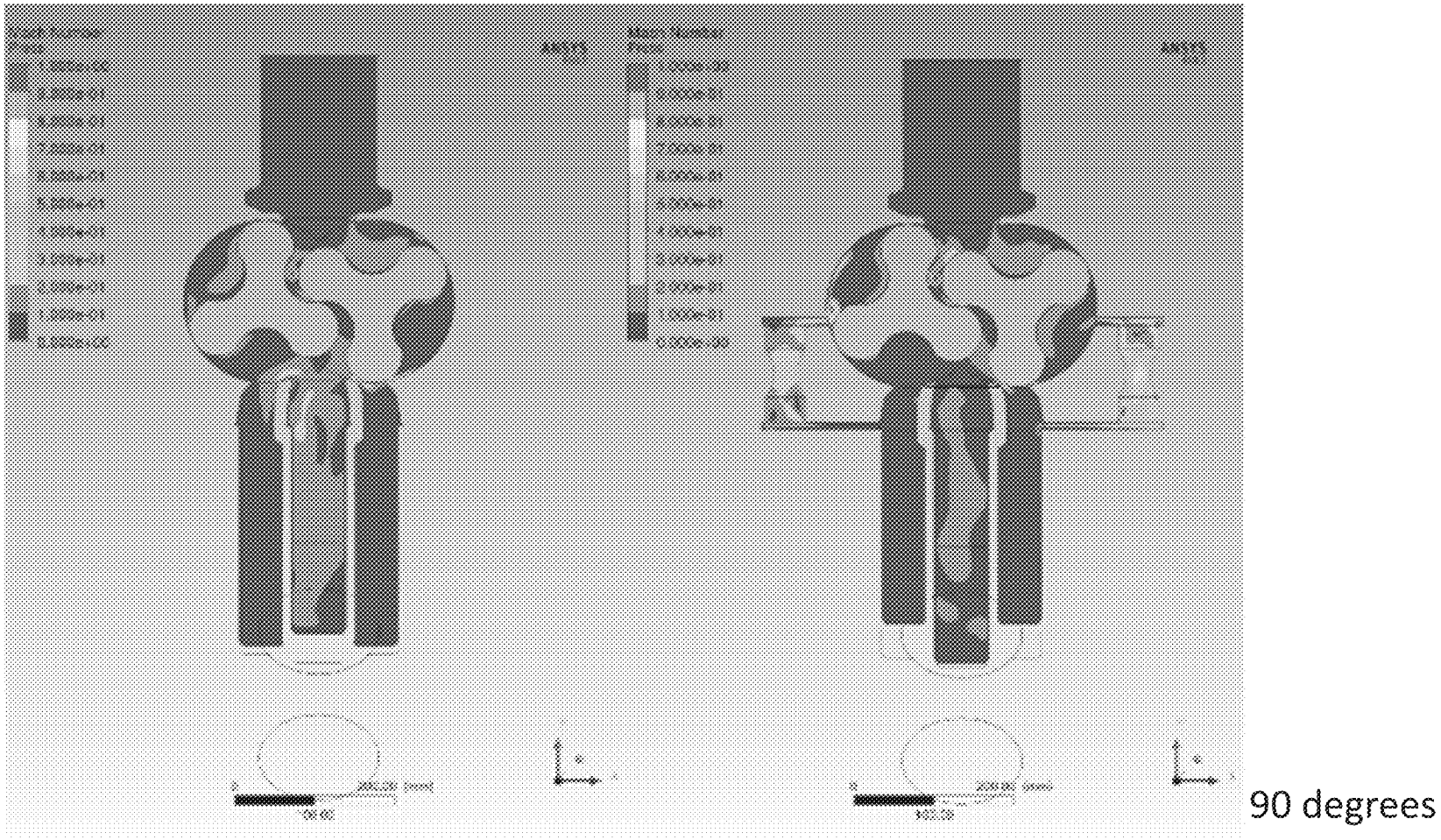
FIG. 26 illustrates operation of a pressure relief system.
Figure 27:
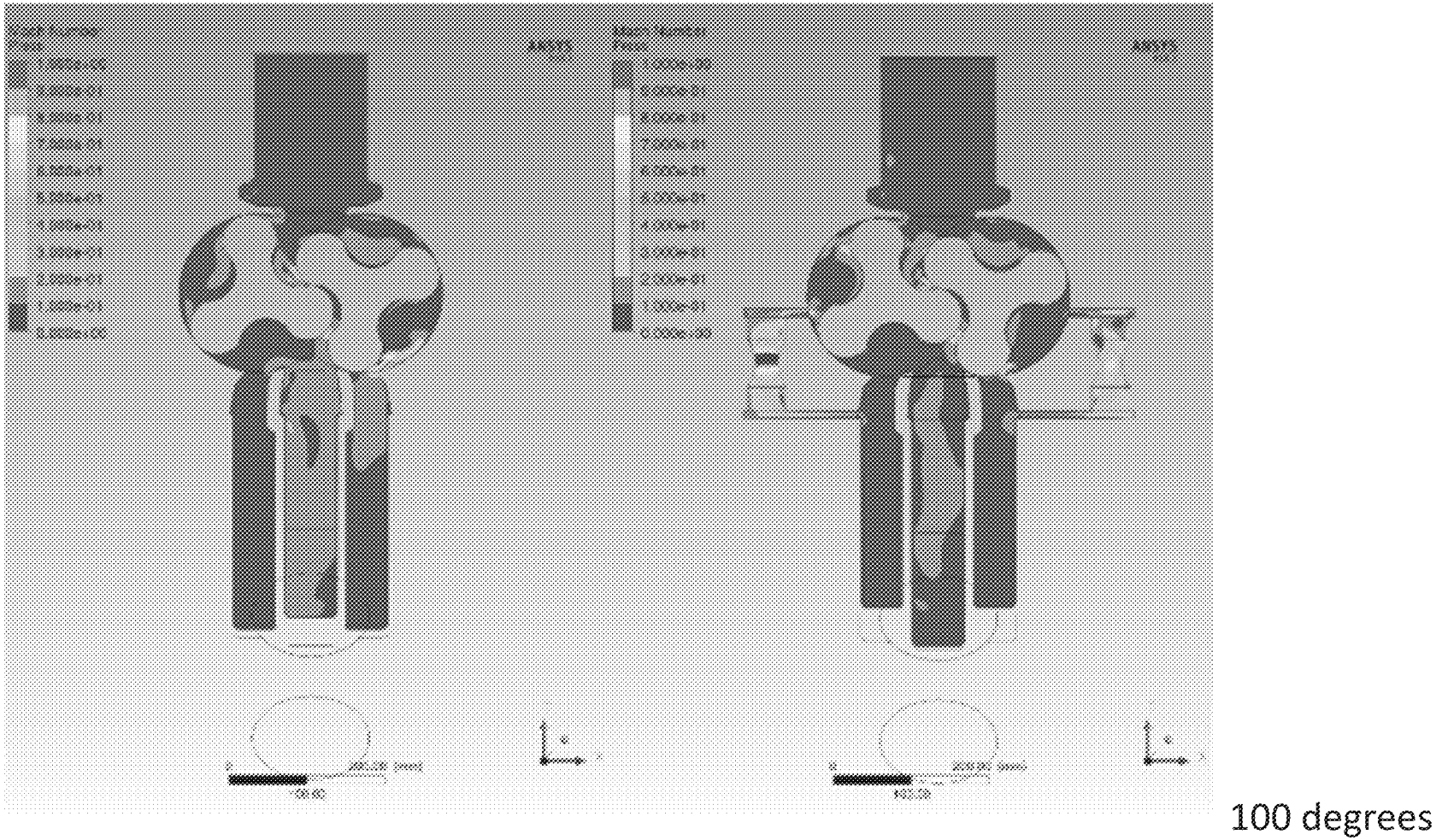
FIG. 27 illustrates operation of a pressure relief system.
Figure 28:
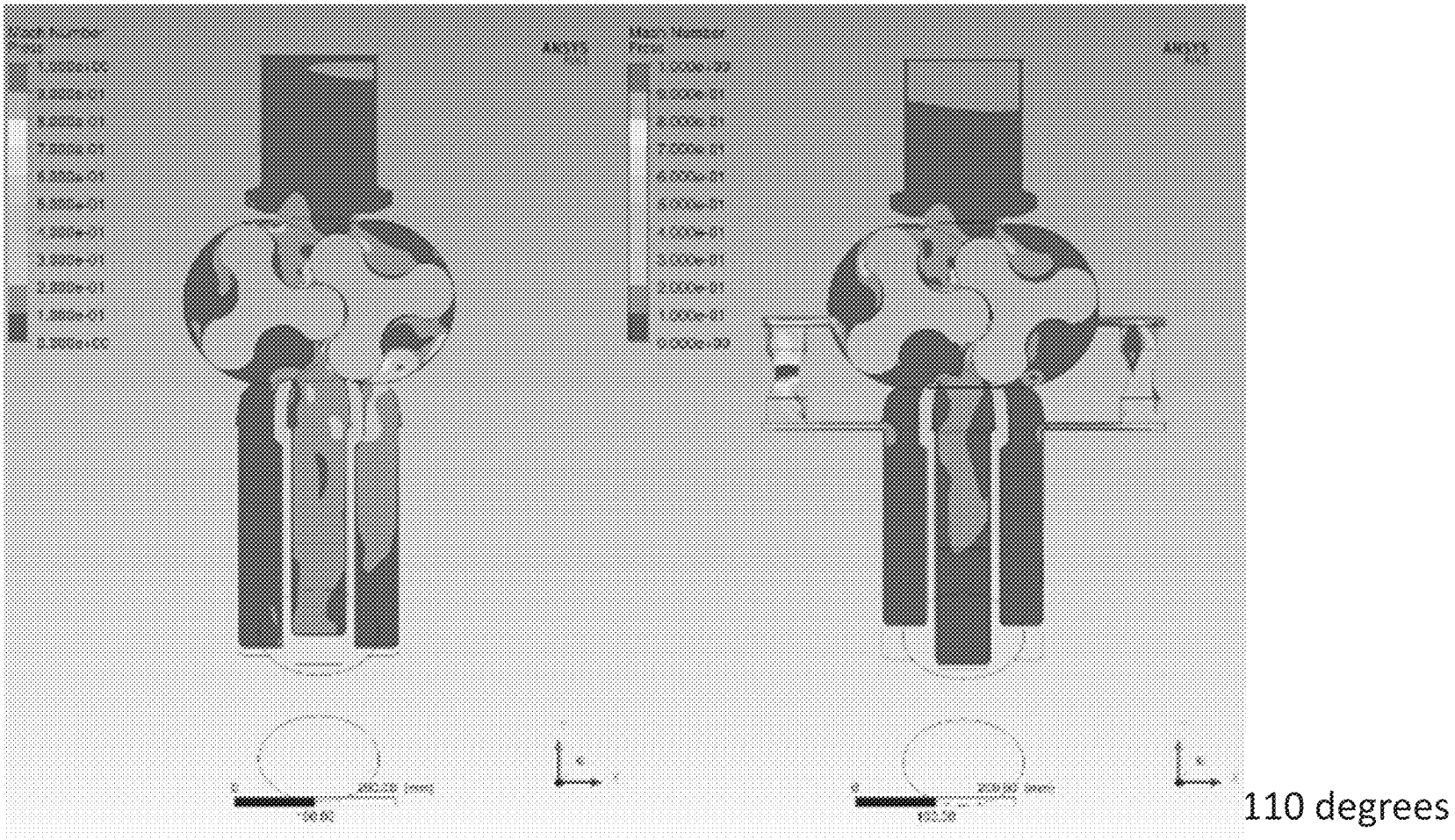
FIG. 28 illustrates operation of a pressure relief system.
Figure 29:
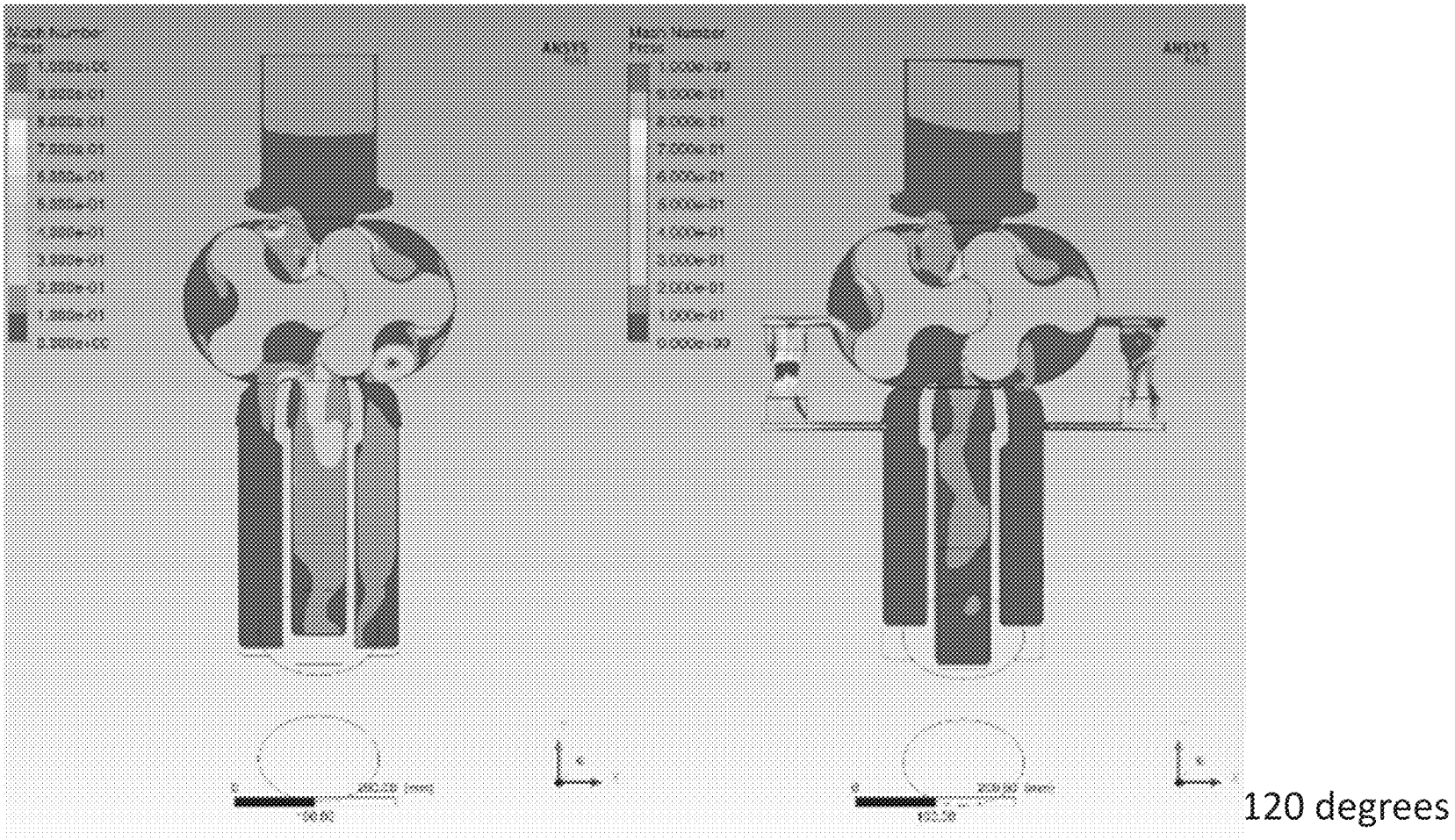
FIG. 29 illustrates operation of a pressure relief system.

The 0 degrees indication in FIG. 17 illustrates a position in which the rotor 56 is about to sweep past the inlet 52 and thereby close off and form a pocket between adjacent lobes of the rotor 56 which will be moved to the outlet 58 upon further rotation of the rotor 56. FIG. 18 illustrates a position in which the pocket is closed off from both the inlet 52 and from the pressure relief injection port 68. Such a position intermediate between the inlet 52 and port 68 is envisioned in many embodiments herein, but alternative embodiments are also contemplated. FIG. 19 depicts a rotational position of rotor 56 where the pocket is initially opened to the injection port 72 where pressure relief gas can begin filling in to the pocket. Feature 86 illustrates a change in velocity occurring near the injection port 68 which indicates an infilling process. FIG. 20 illustrates the continuation of infilling of the pocket through the pressure relief system 62.

FIGS. 21-24 illustrate a sonic flow condition at the throat of the sonic passage 66 which can be indicative of shock formation as gas reaches its mass flow rate limit through the passage 66 as a result of the area ratio. Feature 88 illustrates the sonic flow as a dark banded region at the throat of the passage 66. FIGS. 25-29 illustrate further rotation of the rotor 56 in which gas is infilling to the pocket but without formation of a sonic or shock condition at the throat of the sonic passage 66 due to the falling pressure difference between the pocket and the injection port 68 as a result of the movement of gas to the pocket.

As will be appreciated given the discussion above, the rotors 54 and 56 rotate through several regions which can be characterized by the location of its pocket and whether the pocket is in fluid communication with any respective passage such as the inlet 52, injection port 68, and outlet 74. Region (1) can be characterized by the pocket being open to inlet 52, closed to pressure relief passage such as the injection port 68, and closed to outlet 74. Region (2) can be characterized by the pocket being closed to inlet 52, open to pressure relief inlet such as the port 68, and closed to outlet 74. Region (3) can be characterized as the pocket being closed to inlet 52, closed to pressure relief passage such as the port 68, and open to outlet 74. In those embodiments having the cooling air inlet 60, another region can be added which is characterized by the pocket being closed to inlet 52, open to pressure relief inlet such as the port 68, open to the cooling air inlet 60, and closed to outlet 74. Such a region might be designated as Region (2a), where Region (2) is further characterized as the pocket being closed to the cooling air inlet 60. Yet another region can be added which is characterized by the pocket being closed to inlet 52, closed to pressure relief inlet such as the port 68, open to the cooling air inlet 60, and open to outlet 74. Such a region might be characterized as Region (3a), with Region (3) being further characterized as the pocket being closed to the cooling air inlet 60.

In one form the vacuum roots blower 50 can be free on the pressure relief passage side (e.g. pressure relief system 62) from the presence of any passive sound attenuating structures such as dampeners/foams/perforated plates/etc and/or any tube/chamber style mufflers or traps. In one non-limiting example, the blower 50 and/or pressure relief system 62 can be free from a resonant chamber situated immediately outside of the pressure relief inlet opening. An example of a resonant chamber which need not be used in embodiments of the instant application is a double walled chamber forming a plenum volume larger in dimension than a passageway that feeds fluid to and from the plenum. An example of a double walled chamber includes one in which one side of a wall is occupied by the rotor and the other side of the wall forming a chamber volume with the housing where the chamber volume includes a height and/or depth larger than a dimension of a pressure relief passage leading to the chamber. Examples of passive sound attenuating structures which can be absent from any of the embodiments of the instant application can be found in U.S. Pat. No. 9,140,260 (e.g. the pulsation trap chambers).

It will be appreciated that embodiments can, but need not, provide for the isolation of the pressure relief system 62 from the outlet 58 or to a conduit that leads from the outlet 58. The term "isolated" or "isolation" is intended to include those situations in which the pressure relief system 62 is not connected to form a bypass or other recycling conduit flow path in which some amount of gas is extracted from the outlet 58 and cycled back through the pressure relief system 62. The term "isolated" or "isolation" does not include those situations in which the outlet is vented to atmosphere and the pressure relief passage is connected to atmosphere.

The arc length of travel associated with the rotor 56 in which the pressure relief passage 62 provides gas into the pocket, and where over that arc length the pocket is sealed from the inlet 52 and the exit 58 by virtue of the position of the rotor within the volume (e.g. Region (2)) can be at least 35 degrees in some embodiments, while in others it can be 40, 45, 50, 55, 60, 65, 70, and 75 degrees, and in some forms can be up to 90 degrees. Different arc lengths of travel are contemplated depending on whether the rotor 56 is a three lobed or four lobed rotor. It will be appreciated that the term "sealed" as used in this context includes those situations in which the rotor may not be perfectly contacted along the entirely of the surface and instead may include a lift or other imperfection of contact that permits a small to negligible amount of gas to leak past. It can of course also include those circumstances in which a perfect fluid tight seal is formed.

The arc length of travel associated with the rotor 56 in which a sonic condition is present in the restriction (or opening in those embodiments which include a slit or other like structure formed in the housing) is at least 10 degrees, can be 20 degrees, and in some forms can persist to larger angular rotations such as those associated with the arc length of fluid communication listed above. Accordingly, the arc length of fluid communication from the pressure relief system 62 to the pocket can substantially coincide with the arc length associated with a sonic condition at the restriction (or opening), but need not necessarily coincide in all embodiments.

The location of the upstream edge of the opening of the pressure relief system 62 into the pocket (e.g. via the port 68) can be anywhere between at least 60 degrees and at least 120 degrees from the 12 o'clock position, and in some forms can be higher. At most the pressure relief passage opening (e.g. through port 68) can be positioned to higher angles up to 170 degrees. To set forth just a few nonlimiting example, the angular position can be up to about 125, 130, 135, 140, 145, 150, 155, 160, 165, and 170 degrees.

Figure 30:
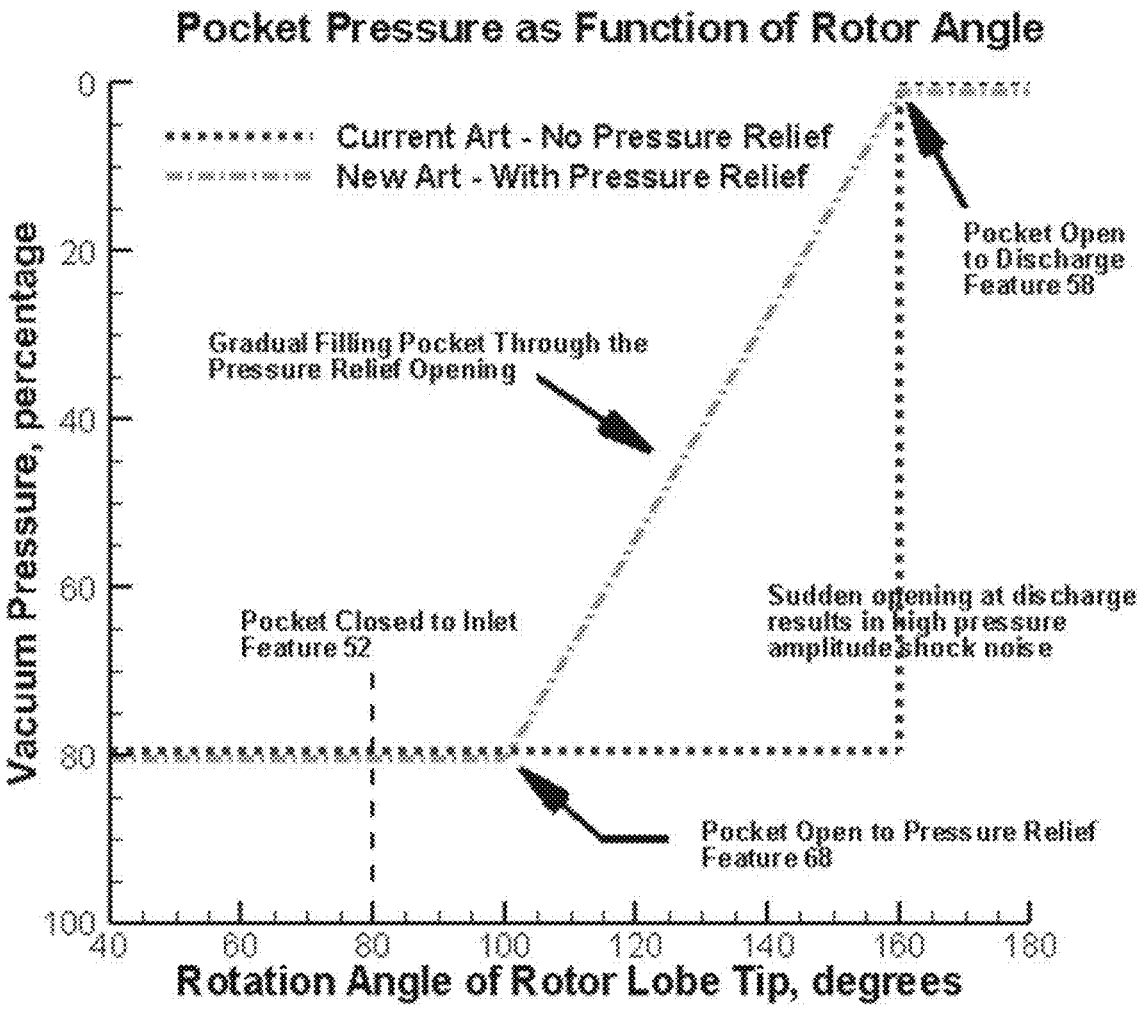
FIG. 30 illustrates operation of a pressure relief system.

FIG. 30 depicts a diagrammatic view of pressure within the pocket as a function of the rotational angle of the rotor. The y-axis denotes the vacuum pressure within the pocket, with 0% at the top of the y-axis denoting 0% vacuum, and the lower level of the y-axis denoting about 80% vacuum. The x-axis denotes the range over which the rotor is rotating. As can be seen in the diagram, the pocket can be closed to the inlet in this example embodiment around 80 degrees, the pocket can be open to the pressure relief around 100 degrees, and the pocket can thereafter be opened to the discharge around 160 degrees. Although the pressure rise (or loss of vacuum) is illustrated for convenience to occur in a linear fashion, no limitation is hereby implied or stated that such pressure rise need occur in this manner. Some embodiments can have different pressure rise characteristics as will be appreciated by those of skill in the art. Also shown on the figure is the very rapid rise in pressure (or loss of vacuum) associated with the prior art device.

Figure 31:
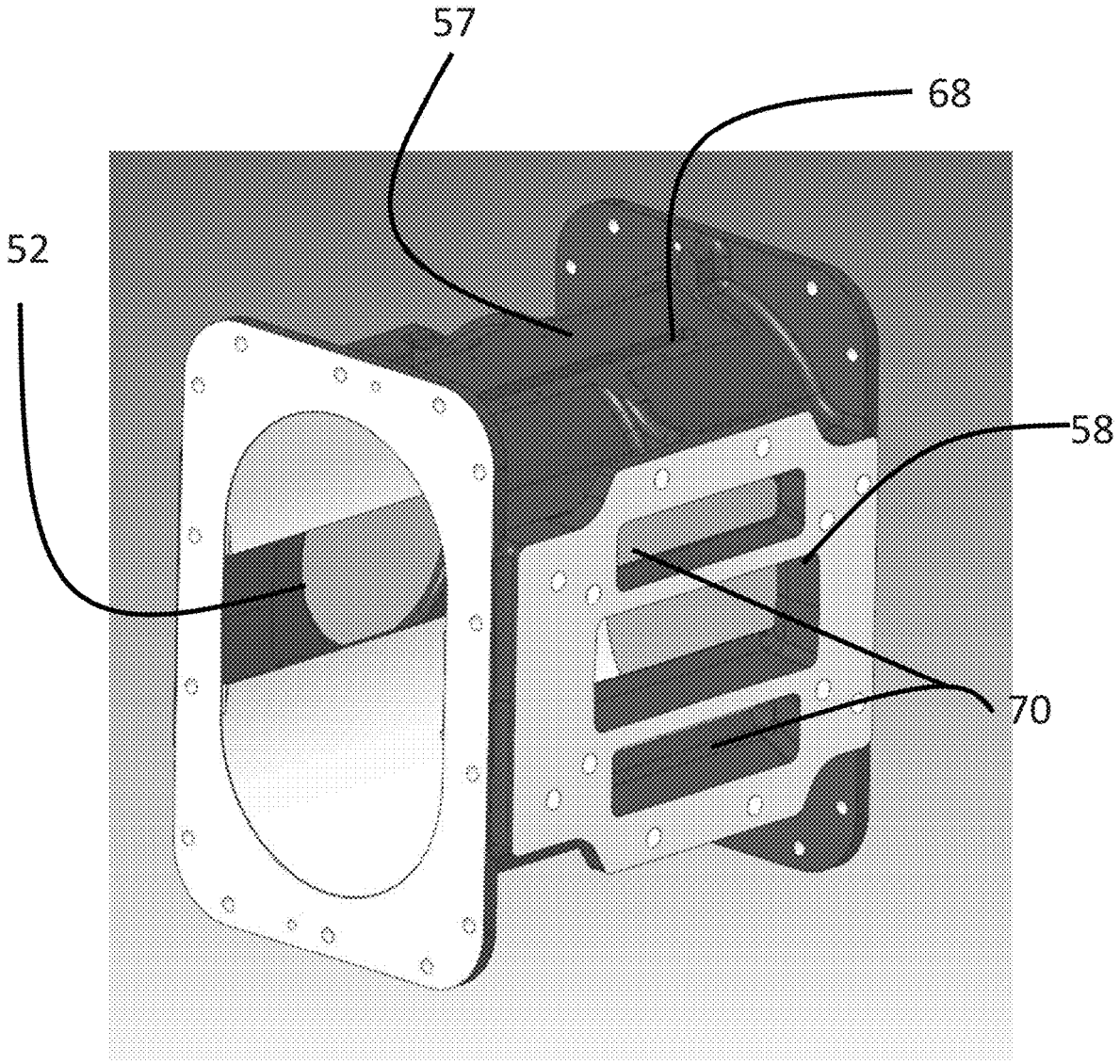
FIG. 31 illustrates an embodiment of a housing.

FIG. 31 depicts an embodiment of the housing 57. Also illustrated are the cooling air passages 70, outlet 58, and inlet 52. The injection port 68 is illustrated as an elongated opening.

Figure 32:
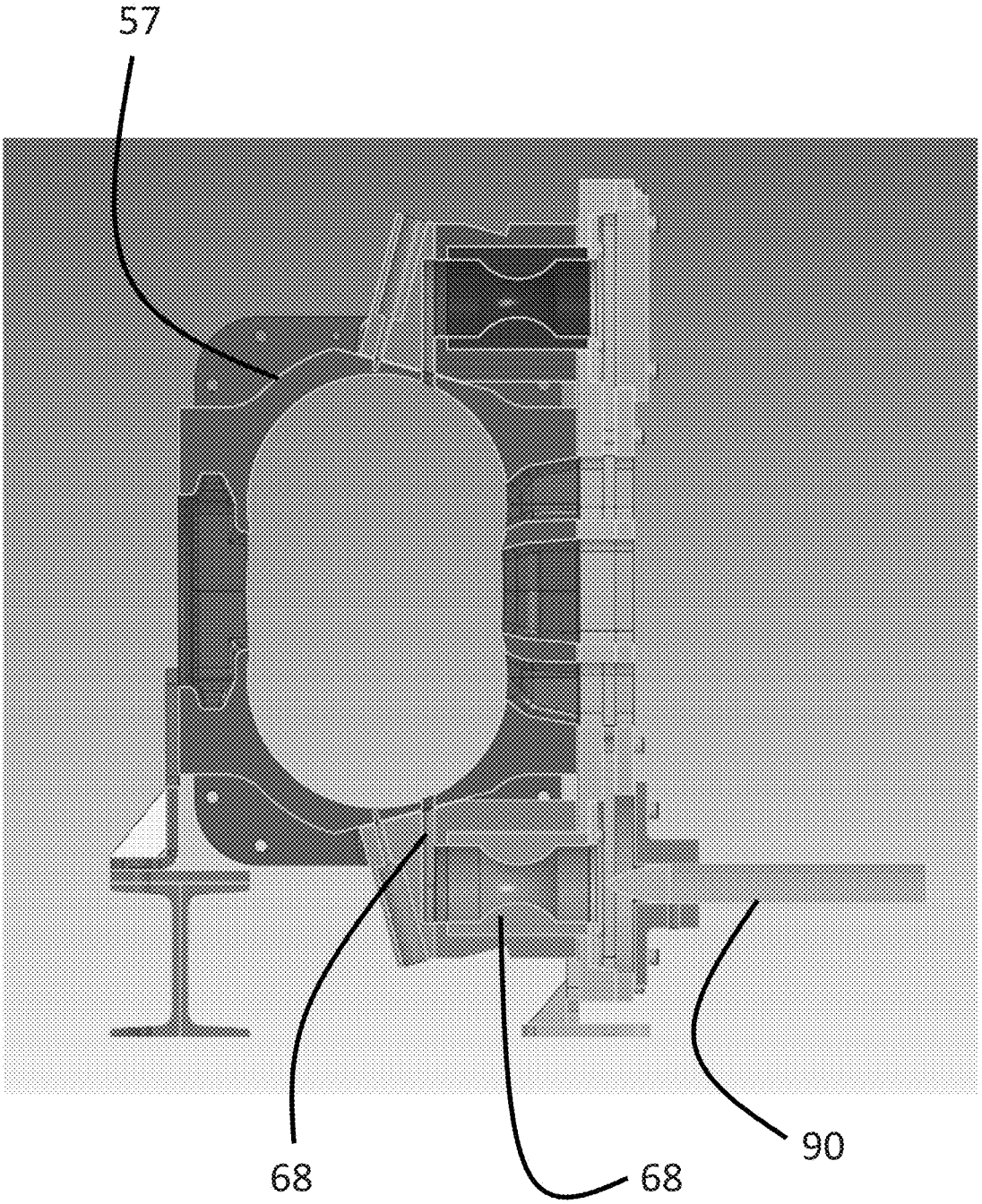
FIG. 32 illustrates an embodiment of a housing and valve member.

FIG. 32 depicts a view of one embodiment of the housing 57 which includes injection ports 68 and sonic passages 66 located on either side of the open interior into which the rotors are disposed. The injection port 68 located on the bottom of the figure is in fluid communication with a valve member 90 capable of being moved in a direction along its elongate axis. Such valve member 90 can be moveable with the flow path to increase or decrease the flow through the injection port 68. In the illustration of FIG. 32 the valve member 90 can be moved in the left or right direction, and in some forms can be inserted into the interior of the injection port 68. The valve member 90 can be operated manually or through use of a controller and actuator as discussed above. Although the illustration depicts only a single valve member 90 used in the lower injection port 68, other embodiments can include a valve member 90 in the upper injection port 68. The valve members 90 used within of the flow paths providing fluid to the injection ports 68 can be the same or different.

The physical processes provided by the embodiments described herein are useful to attenuate noise. Such physical processes can include the ability to de-phase a noise signature, such as through trapping a noise within the pocket by virtue of the small throat. Sound can be reflected around in the venture and become attenuated. In other additional and/or alternative physical processes, the sonic condition and resultant velocity of fluid through the pressure relief system can act to prohibit the transmission of noise upstream through the sonic passage 66. For example, if the sonic condition occurs at the throat and fluid is further accelerated downstream of the throat toward the pocket as a CD nozzle diverges, then noise generated within the pocket as a result of the inrush of gas cannot propagate upstream in the presence of such fluid that is flowing faster than the sonic speed.

One aspect of the present application includes an apparatus comprising: a vacuum pump housing having an inlet structured to receive an incoming flow of a compressible fluid, an outlet structured to receive an outgoing flow of a compressible fluid, and a pressure relief passage having a pressure relief inlet located intermediate the inlet and outlet which is structured to provide an incoming flow of pressure relief fluid, and a pair of intermeshed rotating members supported for complementary rotation within the vacuum pump housing, the rotating members and vacuum pump housing forming respective operating volumes there between which rotates with the rotating member and in which the operating volume is variable with rotation of the rotating member, each of the respective operating volumes having the following regions: (1) open to inlet/closed to pressure relief passage/closed to outlet; (2) closed to inlet/open to pressure relief inlet/closed to outlet; and (3) closed to inlet/closed to pressure relief passage/open to outlet, wherein the pressure relief passage includes a restriction in which the cross sectional area is sized to produce a sonic condition resulting in a choked flow condition of the restriction during at least a portion of when each of the respective operating volumes is in region (2).

A feature of the present application includes wherein the pressure relief inlet is structured as an elongated entry to the respective volumes.

Another feature of the present application includes wherein the restriction is a throat of a convergent-divergent valve.

Yet another feature of the present application includes wherein the pressure relief passage flows through a valve with variable throat area, and wherein the pressure relief inlet is positioned between about 80 degrees and 140 degrees from a 12 o'clock position.

Still another feature of the present application includes wherein region (2) occurs over an arc length of rotation of one of the intermeshed rotating members of at least 35 degrees.

Yet still another feature of the present application includes wherein region (2) occurs over an arc length of rotation of one of the intermeshed rotating members of at least 60 degrees, and wherein the restriction is the variable throat area.

Still yet another feature of the present application includes wherein the operating volume is at a pressure less than a static pressure in the outlet as the operating volume first transitions from region (2) to region (3), and wherein a flow path through the pressure relief passage to the pressure relief inlet is free of a passive sound attenuating structure.

A further feature of the present application includes wherein the vacuum pump housing further includes a cooling air inlet disposed between the pressure relief passage and the outlet, and wherein the pressure relief passage can be routed from a cooling air duct which feeds cooling air to the cooling air inlet.

A still further feature of the present application includes wherein the pressure relief passage includes an end in fluid communication with ambient air such that the pressure relief passage is structured to convey ambient air, and wherein the vacuum pump housing is free of sound attenuating devices.

Another aspect of the present application includes an apparatus comprising: a roots vacuum pump having a pair of counter rotational rotors structured to be cooperatively engaged and interengagingly rotated to pull a vacuum, each of the pair of counter rotational rotors having a plurality of respective lobes, an inlet structured to provide a compressible fluid to the intake side of the roots vacuum pump, an outlet positioned opposite the inlet and structured to flow the compressible fluid, and a pair of pressure relief passages having respective openings into the roots vacuum pump and which are disposed on opposing sides of the roots vacuum pump and structured to provide a pressure relief fluid, wherein each of the pair of counter rotational rotors includes a pressure relief rotatable position in which adjacent lobes form a volume which is in fluid communication with a respective one of the pair of pressure relief passages and in which the adjacent lobes discourage fluid communication from either of the inlet and the outlet, each of the pair of pressure relief passages including a restriction sized to form a shock wave during operation of the roots vacuum pump when pressure relief fluid is flowed toward the respective volumes.

A feature of the present application includes wherein the pressure relief passage includes a convergent-divergent passage having a throat, the throat forming the restriction.

Another feature of the present application includes wherein the pressure relief passage is in the form of an elongate opening in the roots vacuum pump, the elongate opening in fluid communication with the volume when each of the pair of counter rotational rotors are in the pressure relief rotatable position.

Still another feature of the present application includes wherein the restriction is a variable area restriction.

Yet another feature of the present application includes wherein the volume is formed over an angular range of motion of the adjacent lobes of at least 45 degrees, and in which the pressure relief passages are free from passive sound attenuating structures.

Still another feature of the present application includes wherein the pressure relief rotatable position of the adjacent lobes form the volume open to the pressure relief passage when a trailing lobe of the adjacent lobes traverses an angle between 5 and 15 degrees after the inlet is closed.

Yet still another feature of the present application further includes a cooling gas inlet structured to provide cooling gas and positioned intermediate the outlet and the pressure relief passages, and wherein the respective openings permit fluid to enter the roots vacuum pump over an angular range of motion of the pair of counter rotational rotors, and wherein the angular range of motion is at an arc position which discourages fluid from entering via the cooling gas inlet.

Still yet another feature of the present application includes wherein the pressure relief passage includes an opening to ambient such that ambient air is used as a pressure relief fluid that flows into the respective volumes when each of the pair of counter rotational rotors are in the pressure relief rotatable position.

Still another aspect of the present application includes a method comprising: rotating a first rotor of a pair of intermeshed first and second rotors associated with a vacuum roots blower, the vacuum roots blower having an inlet and an outlet, flowing a pressure relief fluid into a volume created between adjacent lobes of the first rotor when the first rotor passes an opening from a pressure relief passage, the inlet and the outlet blocked by the adjacent lobes when the pressure relief fluid is flowed into the volume, forming a shock wave in a restriction formed in the pressure relief passage, and ceasing a flow of pressure relief fluid once the first rotor has traversed at least 45 degrees after the beginning of the flowing a pressure relief fluid.

A feature of the present application further includes varying the cross sectional area of the restriction during the flowing.

Another feature of the present application further includes flowing a fluid within the pressure relief passage direct to the opening without forming a sound attenuating chamber volume larger in cross sectional area than the pressure relief passage.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. An apparatus comprising:

a vacuum pump housing having an inlet structured to receive an incoming flow of a compressible fluid, an outlet structured to receive an outgoing flow of a compressible fluid, and a pressure relief passage having a pressure relief inlet located intermediate the inlet and outlet which is structured to provide an incoming flow of pressure relief fluid; and a pair of intermeshed rotating members supported for complementary rotation within the vacuum pump housing, the rotating members and vacuum pump housing forming respective operating volumes there between which rotates with the rotating member and in which the operating volume is variable with rotation of the rotating member, each of the respective operating volumes having the following regions: (1) open to inlet/closed to pressure relief passage/closed to outlet; (2) closed to inlet/open to pressure relief inlet/closed to outlet; and (3) closed to inlet/closed to pressure relief passage/open to outlet;

wherein the pressure relief passage includes a restriction in which the cross sectional area is sized to produce a sonic condition resulting in a choked flow condition of the restriction during at least a portion of when each of the respective operating volumes is in region (2).

2. The apparatus of claim 1, wherein the pressure relief inlet is structured as an elongated entry to the respective volumes.

3. The apparatus of claim 2, wherein the restriction is a throat of a convergent-divergent valve.

4. The apparatus of claim 2, wherein the pressure relief passage flows through a valve with variable throat area, and wherein the pressure relief inlet is positioned between 80 degrees and 140 degrees from a 12 o'clock position.

5. The apparatus of claim 4, wherein region (2) occurs over an arc length of rotation of one of the intermeshed rotating members of at least 35 degrees.

6. The apparatus of claim 5, wherein region (2) occurs over an arc length of rotation of one of the intermeshed rotating members of at least 60 degrees, and wherein the restriction is the variable throat area.

7. The apparatus of claim 5, wherein the operating volume is at a pressure less than a static pressure in the outlet as the operating volume first transitions from region (2) to region (3), and wherein a flow path through the pressure relief passage to the pressure relief inlet is free of a passive sound attenuating structure.

8. The apparatus of claim 5, wherein the vacuum pump housing further includes a cooling air inlet disposed between the pressure relief passage and the outlet, and wherein the pressure relief passage can be routed from a cooling air duct which feeds cooling air to the cooling air inlet.

9. The apparatus of claim 5, wherein the pressure relief passage includes an end in fluid communication with ambient air such that the pressure relief passage is structured to convey ambient air, and wherein the vacuum pump housing is free of sound attenuating devices.

10. An apparatus comprising:

a roots vacuum pump having a pair of counter rotational rotors structured to be cooperatively engaged and interengagingly rotated to pull a vacuum, each of the pair of counter rotational rotors having a plurality of respective lobes;

an inlet structured to provide a compressible fluid to the intake side of the roots vacuum pump;

an outlet positioned opposite the inlet and structured to flow the compressible fluid; and a pair of pressure relief passages having respective openings into the roots vacuum pump and which are disposed on opposing sides of the roots vacuum pump and structured to provide a pressure relief fluid;

wherein each of the pair of counter rotational rotors includes a pressure relief rotatable position in which adjacent lobes form a volume which is in fluid communication with a respective one of the pair of pressure relief passages and in which the adjacent lobes discourage fluid communication from either of the inlet and the outlet, each of the pair of pressure relief passages including a restriction sized to form a shock wave during operation of the roots vacuum pump when pressure relief fluid is flowed toward the respective volumes.

11. The apparatus of claim 10, wherein the pressure relief passage includes a convergent-divergent passage having a throat, the throat forming the restriction.

12. The apparatus of claim 10, wherein the pressure relief passage is in the form of an elongate opening in the roots vacuum pump, the elongate opening in fluid communication with the volume when each of the pair of counter rotational rotors are in the pressure relief rotatable position.

13. The apparatus of claim 12, wherein the restriction is a variable area restriction.

14. The apparatus of claim 13, wherein the volume is formed over an angular range of motion of the adjacent lobes of at least 45 degrees, wherein the pressure relief passages are free from passive sound attenuating structures, and wherein the roots vacuum pump is coupled with a control system that can automatically adjust the variable area restriction.

15. The apparatus of claim 14, wherein the pressure relief rotatable position of the adjacent lobes form the volume open to the pressure relief passage when a trailing lobe of the adjacent lobes traverses an angle between 5 and 15 degrees after the inlet is closed.

16. The apparatus of claim 12, which further includes a cooling gas inlet structured to provide cooling gas and positioned intermediate the outlet and the pressure relief passages, and wherein the respective openings permit fluid to enter the roots vacuum pump over an angular range of motion of the pair of counter rotational rotors, and wherein the angular range of motion is at an arc position which discourages fluid from entering via the cooling gas inlet.

17. The apparatus of claim 12, wherein the pressure relief passage includes an opening to ambient such that ambient air is used as a pressure relief fluid that flows into the respective volumes when each of the pair of counter rotational rotors are in the pressure relief rotatable position.

18. A method comprising:

rotating a first rotor of a pair of intermeshed first and second rotors associated with a vacuum roots blower, the vacuum roots blower having an inlet and an outlet;

flowing a pressure relief fluid into a volume created between adjacent lobes of the first rotor when the first rotor passes an opening from a pressure relief passage, the inlet and the outlet blocked by the adjacent lobes when the pressure relief fluid is flowed into the volume;

forming a shock wave in a restriction formed in the pressure relief passage; and ceasing a flow of pressure relief fluid once the first rotor has traversed at least 45 degrees after the beginning of the flowing a pressure relief fluid.

19. The method of claim 18, which further includes varying the cross sectional area of the restriction during the flowing.

20. The method of claim 19, which further includes flowing a fluid within the pressure relief passage direct to the opening without forming a sound attenuating chamber volume larger in cross sectional area than the pressure relief passage.

* * * * *